US012698927B2

(12) United States Patent
Swallow et al.

(10) Patent No.: US 12,698,927 B2
(45) Date of Patent: Aug. 4, 2026

(54) METHODS AND SYSTEMS FOR CONTROLLING A COMPRESSOR COOLING SYSTEM

(71) Applicant: Copeland LP, Sidney, OH (US)

(72) Inventors: Matthew J. Swallow, Versailles, OH (US); Michael M. Perevozchikov, Tipp City, OH (US); Clayton Kern, Telluride, CO (US)

(73) Assignee: Copeland LP, Sidney, OH (US)

( * ) Notice: Subject to any disclaimer, the term of this patent is extended or adjusted under 35 U.S.C. 154(b) by 213 days.

(21) Appl. No.: 18/416,259

(22) Filed: Jan. 18, 2024

(65) Prior Publication Data

US 2025/0044000 A1 Feb. 6, 2025

Related U.S. Application Data

(60) Provisional application No. 63/517,009, filed on Aug. 1, 2023.

(51) Int. Cl.
*F25B 31/00* (2006.01)
*F25B 49/02* (2006.01)

(52) U.S. Cl.
CPC ..... *F25B 31/006* (2013.01); *F25B 49/022* (2013.01)

(58) Field of Classification Search
CPC ..... F25B 31/006; F25B 49/022
See application file for complete search history.

(56) References Cited

U.S. PATENT DOCUMENTS 3,165,905 A 1/1965 Ware
3,913,346 A 10/1975 Moody, Jr. et al.
4,573,324 A 3/1986 Tischer et al.
4,632,358 A 12/1986 Orth et al.
4,903,497 A 2/1990 Zimmern et al.
5,582,002 A 12/1996 Pattas
5,692,389 A 12/1997 Lord et al.
(Continued)

FOREIGN PATENT DOCUMENTS

EP 3467402 A1 4/2019
WO 2022154964 A1 7/2022
WO WO 2022154964 * 7/2022

OTHER PUBLICATIONS

International Search Report and Written Opinion issued in International Application No. PCT/US2024/039673 mailed on Oct. 28, 2024, pp. 1-22.

*Primary Examiner* — Henry T Crenshaw
(74) *Attorney, Agent, or Firm* — Armstrong Teasdale LLP

(57) ABSTRACT

A method includes commanding a motor coolant control valve to open at a first time to provide a supply of coolant to a motor coolant flow channel that delivers coolant to a motor of a compressor. A first detection of a coolant return temperature is received at a first time from a temperature sensor connected to a coolant return line that receives coolant from the motor coolant flow channel and returns coolant to another portion of the compressor. A second detection of the coolant return temperature from the temperature sensor is received at a second time after the first time. Based on the first detection and the second detection of the coolant return temperature, it is determined if the motor coolant control valve opened at the first time, and remedial action is taken when the motor coolant control valve is determined not to have opened at the first time.

18 Claims, 12 Drawing Sheets

(56) References Cited

U.S. PATENT DOCUMENTS

| | | | | |
|---|---|---|---|---|
| 5,704,215 | A | 1/1998 | Lord et al. | |
| 5,980,218 | A | 11/1999 | Takahashi et al. | |
| 6,032,472 | A | 3/2000 | Heinrichs et al. | |
| 8,465,265 | B2 | 6/2013 | De Larminat | |
| 8,516,850 | B2 | 8/2013 | Jadric et al. | |
| 8,959,904 | B2 * | 2/2015 | Porras | F01N 9/00 60/274 |
| 9,291,167 | B2 | 3/2016 | Schreiber | |
| 9,395,111 | B2 | 7/2016 | Sommer et al. | |
| 9,574,805 | B2 | 2/2017 | Yang et al. | |
| 9,822,998 | B2 | 11/2017 | Knopp et al. | |
| 10,018,393 | B2 | 7/2018 | Kopko et al. | |
| 10,184,701 | B2 | 1/2019 | Sun et al. | |
| 10,480,831 | B2 | 11/2019 | Jonsson et al. | |
| 10,539,352 | B2 | 1/2020 | Jonsson et al. | |
| 10,724,546 | B2 | 7/2020 | Morgan et al. | |
| 10,823,467 | B2 | 11/2020 | Jonsson et al. | |
| 11,391,291 | B2 | 7/2022 | Groshek et al. | |
| 2007/0175414 | A1 * | 8/2007 | Miyahara | F01P 11/16 123/41.1 |
| 2008/0115527 | A1 | 5/2008 | Doty et al. | |
| 2011/0243762 | A1 | 10/2011 | Daikoku et al. | |
| 2013/0089436 | A1 | 4/2013 | Bialas et al. | |
| 2013/0125570 | A1 | 5/2013 | Doty et al. | |
| 2014/0010675 | A1 * | 1/2014 | Kent | F04B 43/009 417/476 |
| 2014/0374495 | A1 * | 12/2014 | Malone | G05D 23/1854 236/34.5 |
| 2015/0306456 | A1 | 10/2015 | Pasini et al. | |
| 2016/0116190 | A1 | 4/2016 | Oda et al. | |
| 2016/0282851 | A1 * | 9/2016 | Cartwright | G05B 19/4155 |
| 2017/0115650 | A1 * | 4/2017 | Holleran | F24F 11/63 |
| 2018/0094626 | A1 | 4/2018 | Kobayashi et al. | |
| 2018/0180333 | A1 | 6/2018 | Sishtla et al. | |
| 2018/0231006 | A1 | 8/2018 | Sun | |
| 2018/0298863 | A1 * | 10/2018 | Kondo | F02N 11/0825 |
| 2018/0306193 | A1 | 10/2018 | Nagao et al. | |
| 2019/0063461 | A1 | 2/2019 | Espelien et al. | |
| 2019/0078795 | A1 * | 3/2019 | Kim | F24F 1/28 |
| 2019/0203998 | A1 | 7/2019 | Crane | |
| 2019/0331244 | A1 * | 10/2019 | Gregory | F16K 49/002 |
| 2019/0353086 | A1 * | 11/2019 | Byun | F02D 41/222 |
| 2020/0240677 | A1 | 7/2020 | Crissman et al. | |
| 2020/0256347 | A1 | 8/2020 | Groshek et al. | |
| 2020/0318883 | A1 | 10/2020 | Nakajima et al. | |

* cited by examiner

METHODS AND SYSTEMS FOR CONTROLLING A COMPRESSOR COOLING SYSTEM

CROSS REFERENCE TO RELATED APPLICATIONS

This application claims priority to U.S. Provisional Patent Application Ser. No. 63/517,009 filed Aug. 1, 2023, which is hereby incorporated by reference in its entirety.

FIELD

The field relates generally to cooling systems for compressors, and more particularly, to methods and systems for controlling a compressor cooling system.

BACKGROUND

Some compressors include cooling systems to provide cooling to the motor and bearings associated with the compressor driveshaft to maintain the motor and bearings within a suitable range of operating temperatures. In at least some systems, one or more cooling paths, such as a cooling path to provide coolant to the motor, can be selectively turned on or off through control of a coolant valve by a controller. Typically, such coolant valves do not include a sensor to provide positive feedback to the controller to confirm that the coolant valve opened when commanded to open. This may lead to insufficient cooling, possible damage to the compressor, and other control complications when the controller commanded the coolant valve to open, but the coolant valve did not in fact open.

This background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

In one aspect, a compressor system includes a compressor, a cooling circuit, and a controller. The compressor includes a compressor housing defining a refrigerant inlet located on a low-pressure side of the compressor, a shaft rotatably supported in the compressor housing, and a motor operably connected to the shaft. The compressor housing includes a motor coolant flow channel that delivers coolant to the motor. The cooling circuit includes a motor coolant supply line, a coolant return line, and a temperature sensor. The motor coolant supply line is connected to the compressor housing to deliver coolant to the motor coolant flow channel. The motor coolant supply line including a motor coolant control valve to control coolant flow through the motor coolant supply line. The coolant return line receives coolant from the motor coolant flow channel and returns coolant to the refrigerant inlet or another portion of the compressor. The temperature sensor is connected to the coolant return line to detect a coolant return temperature that is a temperature of the coolant return line, a temperature of coolant within the coolant return line, or both. The controller has a processor and a memory and is connected to the temperature sensor and the motor coolant control valve. The memory stores instructions that when executed by the processor configure the controller to: control the compressor to compress refrigerant delivered to the refrigerant inlet, open the motor coolant control valve to provide a supply of coolant to the motor coolant flow channel, receive a first detection of the coolant return temperature from the temperature sensor at a first time when the controller opens the motor coolant control valve, receive a second detection of the coolant return temperature from the temperature sensor at a second time after the controller opens the motor coolant control valve, determine, based on the first detection and the second detection of the coolant return temperature, if the motor coolant control valve opened at the first time, and take remedial action when the controller determines that the motor coolant control valve did not open at the first time.

In another aspect, a method of operating a compressor system includes controlling a compressor to compress refrigerant delivered to a refrigerant inlet of the compressor and commanding a motor coolant control valve to open at a first time to provide a supply of coolant to a motor coolant flow channel that delivers coolant to a motor of the compressor. The method includes receiving, at the first time, a first detection of a coolant return temperature from a temperature sensor connected to a coolant return line that receives coolant from the motor coolant flow channel and returns coolant to the refrigerant inlet or another portion of the compressor. A second detection of the coolant return temperature from the temperature sensor is received at a second time after the first time. Based on the first detection and the second detection of the coolant return temperature, it is determined if the motor coolant control valve opened at the first time, and remedial action is taken when the motor coolant control valve is determined not to have opened at the first time.

In yet another aspect, a method of operating a compressor system including a compressor includes controlling a compressor to compress refrigerant delivered to a refrigerant inlet of the compressor and commanding a motor coolant control valve to open at a first time to provide a supply of coolant to a motor coolant flow channel that delivers coolant to a motor of the compressor. A first detection of a coolant return temperature is received at the first time from a temperature sensor connected to a coolant return line that receives coolant from the motor coolant flow channel and returns coolant to the refrigerant inlet or another portion of the compressor. Additional detections of the coolant return temperature are periodically received from the temperature sensor. For each additional detection, it is determined if the additional detection exceeds a sum of the first detection and a threshold amount. The motor coolant control valve is determined to have opened at the first time and determining if the additional detection exceeds the sum is stopped when one of the additional detections exceeds the sum of the first detection and the threshold amount. The motor coolant control valve is determined not to have opened at the first time and determining if the additional detection exceeds the sum is stopped when none of the additional detections exceeds the sum of the first detection and the threshold amount and a predetermined length of time has passed after the first time. A warning is generated when the motor coolant control valve is determined not to have opened at the first time.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

The following figures illustrate various aspects of the disclosure.

Corresponding reference characters indicate corresponding parts throughout the drawings.

DETAILED DESCRIPTION

Figure 1:
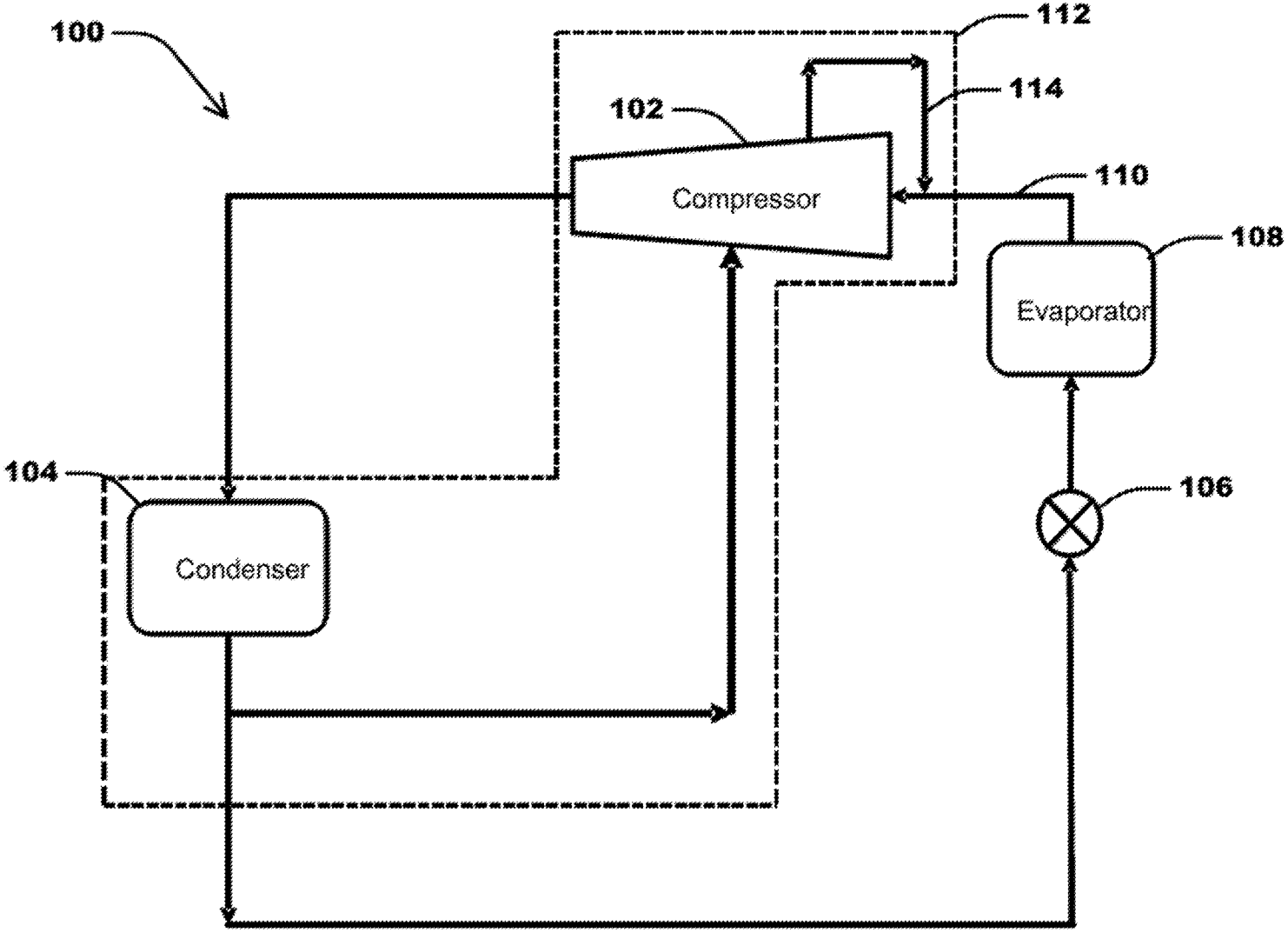
FIG. 1 is a schematic diagram of an example refrigeration system.

FIG. 1 is a schematic diagram of an example refrigeration system 100. The refrigeration system 100 includes a compressor 102, a condenser 104, an expansion device 106 (e.g., an expansion valve, orifice, capillary tube), and an evaporator 108. The refrigeration system 100 may include additional components or other components than those shown and described with reference to FIG. 1 without departing from the scope of the present disclosure. In operation, the compressor 102 receives a working fluid, such as a refrigerant, as a low pressure gas through a suction line 110. The compressor 102 compresses the gas, thereby raising the temperature and pressure of the gas. The pressurized, high temperature gas then flows to the condenser 104, where the high pressure gas is condensed to a high pressure liquid. The liquid then flows through an expansion device 106 that reduces the pressure of the liquid. The reduced pressure fluid, which may be a gas or a mixture of gas and liquid after passing through the expansion device 106, then passes through the evaporator 108. The evaporator 108 may include a heat exchanger, with a fluid circulating therethrough that is cooled by the reduced pressure refrigerant fluid as the refrigerant fluid evaporates to a gas in the evaporator 108. The refrigerant gas is then directed back to the compressor 102 via the suction line 110, where the working fluid is again compressed and the process repeats.

The example refrigeration system 100 includes a compressor cooling system 112 that draws working fluid from part of the refrigerant circuit (downstream of the condenser 104 in this example) and directs it to the compressor 102 to cool components of the compressor 102, such as a motor and bearings of the compressor 102. The working fluid used in the cooling system 112, referred to as "coolant", is returned to the refrigeration circuit by a coolant return line 114 that has an outlet connected to a low pressure side of the compressor 102 (e.g., the suction line 110). As described further herein, the pressure differential across the cooling circuit of the cooling system 112 drives coolant through the compressor 102, and back into the refrigeration circuit.

Figure 2:
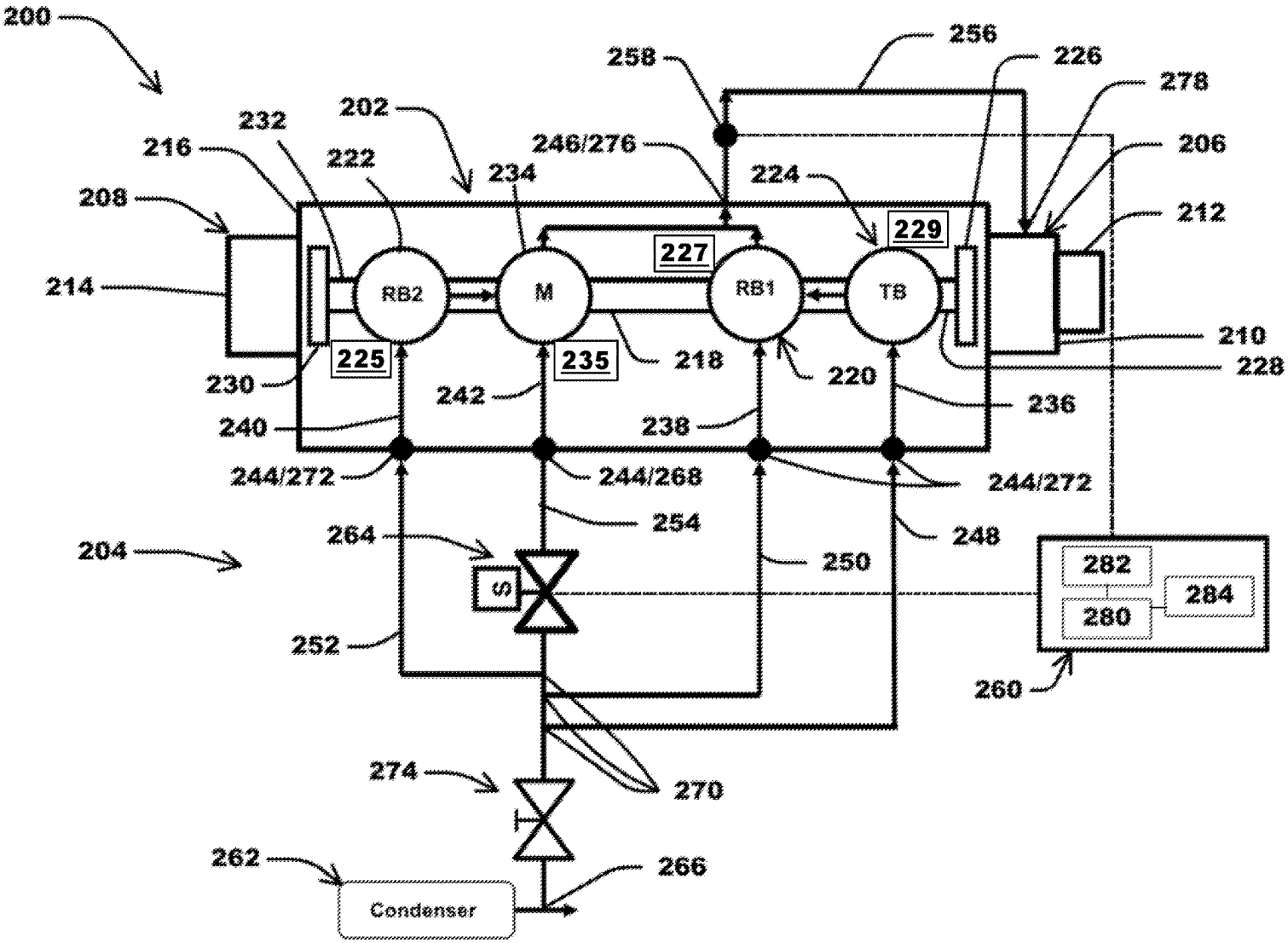
FIG. 2 is a schematic diagram of an example compressor cooling system suitable for use in the refrigeration system of FIG. 1

FIG. 2 is a schematic diagram of an example compressor cooling system 200 suitable for use in the refrigeration system 100 of FIG. 1. The compressor cooling system 200 includes a compressor 202 (e.g., compressor 102) and a cooling circuit 204 configured to deliver coolant to components of the compressor 202 to facilitate cooling the compressor 202 and maintaining components of the compressor 202 within suitable operating temperature ranges.

The compressor 202 of the illustrated embodiment is a two-stage centrifugal compressor 202 that includes a first stage 206 and a second stage 208. In other embodiments, the compressor 202 may include a single stage or may include more than two stages. In yet other embodiments, the compressor 202 may be a compressor other than a centrifugal compressor, such as a scroll compressor. The first stage 206 includes a first stage inlet 210 that is connected in fluid communication with an evaporator (e.g., evaporator 108, shown in FIG. 1) by a suction line 212. The second stage 208 includes a second stage inlet 214 that is connected in fluid communication with a first stage outlet of the first stage 206 by a refrigerant transfer conduit (not shown in FIG. 2) to receive compressed refrigerant from the first stage 206.

The compressor 202 generally includes a housing 216, a shaft 218 rotatably supported in the housing 216 by a plurality of bearings 220, 222, 224, a first stage impeller 226 connected to a first end 228 of the shaft 218, a second stage impeller 230 connected to a second end 232 of the shaft 218, and a motor 234 operably connected to the shaft 218 to drive rotation thereof. The compressor 202 may include components in addition to those shown in FIG. 2.

The housing 216 encloses components of the compressor 202 within one or more sealed (e.g., hermetically or semi-hermitically) cavities. In some embodiments, for example, the housing 216 includes end caps at each stage of the compressor 202 that define volutes in which the first and second stage impellers 226, 230 are positioned. In some embodiments, the housing 216 is formed from a plurality of cast pieces that are assembled using suitable fasteners (e.g., screws, bolts, etc.)

The bearings 220, 222, 224 rotatably support the shaft 218 within the housing 216. In the illustrated embodiment, the compressor 202 includes a first radial bearing 220, a second radial bearing 222, and a thrust bearing 224. In other embodiments, the compressor 202 may include additional or fewer bearings. The bearings 220, 222, 224 may include any suitable type of bearings that enable the compressor 202 to function as described herein including, for example and without limitation, roller-type bearings, magnetic bearings, fluid film bearings, air foil bearings, and combinations thereof. In the illustrated embodiment, each of the bearings 220, 222, 224 comprises an air foil type bearing. In the example embodiment, bearing temperature sensors 225, 227, and 229 are positioned proximate each of the bearings 220, 222, and 224 to provide measurements of the first radial bearing temperature ($T_{RB1}$), the second radial bearing temperature ($T_{RB2}$), and the thrust bearing temperature ($T_{RT}$) to the controller 260. The bearing temperature sensors 225, 227, and 229 may be any suitable temperature sensor and may each measure the temperature of its associated bearing directly (e.g., by measuring the actual temperature of the bearing, such as by contact with the bearing) or indirectly (e.g., by measuring a temperature corresponding to or affected by the actual temperature of the bearing).

The motor 234 is operably connected to the shaft 218 to drive rotation thereof during operation of the compressor 202. The motor 234 may generally include any suitable motor that enables the compressor 202 to function as described herein. In the illustrated embodiment, the motor 234 is an electric motor and includes suitable components (e.g., a stator and a rotor) to impart rotational motion to the shaft 218 during operation of the compressor 202. A motor temperature sensor 235 is positioned to provide measurements of the motor temperature ($T_M$) to the controller 260. Although only one motor temperature sensor 235 is shown in FIG. 2, multiple motor temperature sensors 235 may be used to monitor the temperature of more than one component or location on the motor 234. The motor temperature sensor(s) 235 may be any suitable temperature sensor and may each measure the temperature directly (e.g., by measuring the actual temperature of a component of the motor, such as by contact with the component) or indirectly (e.g., by measuring a temperature corresponding to or affected by the actual temperature of the motor or a component of the motor).

The housing 216 has a plurality of coolant flow channels 236, 238, 240, 242 defined therein that delivers coolant to the bearings 220, 222, 224 and the motor 234. The coolant flow channels 236, 238, 240, 242 may be arranged and/or defined within the compressor housing 216 in any manner that enables the compressor cooling system 200 to function as described herein. For example, the coolant flow channels 236, 238, 240, 242 may be formed as passages in components (e.g., defined in cast components, machined into components, or the like) of the compressor housing 216, as passages defined between two or more components of the compressor 202 (e.g., between the motor 234 and the compressor housing 216), and combinations thereof. Alternatively or additionally, one or more of the coolant flow channels 236, 238, 240, 242 may be separate channels (i.e., separate from and not formed in the housing) positioned in the housing 216. In some embodiments one or more portion of one or more of the coolant flow channels 236, 238, 240, 242 may be external to the housing 216.

The example compressor 202 includes a first coolant flow channel 236, a second coolant flow channel 238, a third coolant flow channel 240, and a fourth coolant flow channel 242. The first coolant flow channel 236 delivers coolant to the thrust bearing 224, the second coolant flow channel 238 delivers coolant to the first radial bearing 220, the third coolant flow channel 240 delivers coolant to the second radial bearing 222, and the fourth coolant flow channel 242 delivers coolant to the motor 234. The fourth coolant flow channel is sometimes referred to as the motor coolant flow channel 242. In some embodiments, the coolant flow channels 236, 238, 240, 242 may share common or overlapping portions. In the illustrated embodiment, for example, the first coolant flow channel 236 overlaps with and feeds into the second coolant flow channel 238 at the first radial bearing 220, and the third coolant flow channel 240 overlaps with and feeds into the fourth coolant flow channel 242 at the motor 234.

Each of coolant flow channels 236, 238, 240, 242 has a corresponding coolant inlet port 244 that connects to the cooling circuit 204 in the example embodiment. That is, the compressor housing 216 includes four external inlet connections for connecting the plurality of coolant flow channels 236, 238, 240, 242 to the cooling circuit 204. In other embodiments, the compressor housing 216 may have fewer external inlet connections. For example, two or more of the coolant flow channels 236, 238, 240, 242 may share a common, single coolant inlet port (and a common connection point to the cooling circuit 204) that provides coolant to multiple of the coolant flow channels 236, 238, 240, 242. In such embodiments, coolant flow delivered to the common coolant inlet port may be separated, divided, or otherwise routed within the compressor housing 216 to deliver coolant to two or more of the coolant flow channels 236, 238, 240, 242. In some embodiments, for example, the bearing coolant flow channels (i.e., the first, second, and third coolant flow channels 236, 238, 240) may have a common coolant inlet port, and the coolant flow may be routed to the separate flow channels internally within the compressor housing 216.

The compressor housing 216 also defines a common coolant outlet port 246 in the illustrated embodiment. The common coolant outlet port 246 receives coolant from each of the plurality of coolant flow channels 236, 238, 240, 242. In other words, all of the coolant delivered to the compressor housing 216 and the coolant flow channels 236, 238, 240, 242 is returned to the common coolant outlet port 246. In some embodiments, at least one of the plurality of coolant flow channels 236, 238, 240 is arranged such that coolant flows through at least one coolant flow channel, in series, across at least one of the bearings 220, 222, 224, through the motor 234, and to the common coolant outlet port 246. In this way, coolant flowing through the at least one coolant flow channel absorbs heat from both the motor 234 and one of the bearings 220, 222, 224. Coolant may flow through the motor 234, for example, by flowing between a stator and a rotor of the motor 234, through a portion of the shaft 218 around which the motor 234 is disposed, and/or through flow channels or holes defined in the rotor of the motor 234.

The cooling circuit 204 delivers coolant to the compressor housing 216 (specifically, to the plurality of coolant flow channels 236, 238, 240, 242) and returns coolant to the refrigeration circuit (e.g., refrigeration system 100 shown in FIG. 1) of which the compressor 202 is a part. The illustrated cooling circuit 204 includes a plurality of coolant supply lines 248, 250, 252, 254, a coolant return line 256, a temperature sensor 258, and a controller 260.

The coolant supply lines 248, 250, 252, 254 are connected in fluid communication with a coolant source 262 and are connected to the compressor housing 216 to deliver coolant to the plurality of coolant flow channels 236, 238, 240, 242. The coolant supply lines 248, 250, 252, 254 can include any suitable fluid conduit (rigid and/or flexible) that enables delivery of coolant to the compressor housing 216 including, for example and without limitation, pipes, hoses, tubes, and combinations thereof. In some embodiments, the coolant supply lines 248, 250, 252, 254 are constructed of metal tubing, such as copper tubing. The illustrated cooling circuit 204 includes four coolant supply lines 248, 250, 252, 254, one for each of the coolant flow channels 236, 238, 240, 242 defined within the compressor housing 216. More specifically, the illustrated embodiment includes a plurality of bearing coolant supply lines 248, 250, 252 and a motor coolant supply line 254. Each of the bearing coolant supply lines 248, 250, 252 is connected to one of the first, second, and third coolant flow channels 236, 238, 240 to channel or deliver coolant to at least one of compressor bearings 220, 222, 224. The motor coolant supply line 254 is connected to the fourth coolant flow channel 242 to deliver coolant to the motor 234.

The example coolant source 262 is the refrigeration circuit of which the compressor 202 is a part, specifically, coolant drawn from the refrigeration circuit downstream of a condenser (e.g., condenser 104, shown in FIG. 1) of the refrigeration circuit, such as between the condenser and an expansion device of the refrigeration system. The coolant is the same working fluid (e.g., refrigerant) used in the refrigerant system in the example. In other embodiments, the coolant source 262 may be a portion of the refrigeration system other than downstream of the condenser, such as the condenser, or any other suitable coolant source that enables the compressor cooling system 200 to function as described herein. In yet other embodiments, the coolant source 262 may be an auxiliary liquid cycle.

As explained further herein, coolant is drawn from the coolant source 262 and through the cooling circuit 204 using a pressure differential between the coolant source 262 and an outlet end of the return line 256. In other embodiments, coolant may be directed through the cooling circuit 204 using additional or alternative means, such as a pump.

The motor coolant supply line 254 includes a motor coolant control valve 264 (sometimes referred to simply as the control valve 264) to control coolant flow through the motor coolant supply line 254. The control valve 264 includes an electrically-actuatable valve that is controllable by the controller 260 to vary or otherwise control the flow rate of coolant through the corresponding supply line. Suitable valves include, for example and without limitation, solenoid valves, electronic expansion valves, and modulating control valves. In other embodiments, one or more of the bearing coolant supply lines 248, 250, 252 may include a coolant control valve 264. In yet other embodiments, the motor coolant supply line 254 and one or more of the bearing coolant supply lines 248, 250, 252 may include a coolant control valve 264.

The motor coolant supply line 254 is configured as a primary or main coolant supply line in the illustrated embodiment, having an inlet 266 connected to the coolant source 262 and an outlet 268 connected to the compressor housing 216 to deliver coolant to the fourth coolant flow channel 242. The bearing coolant supply lines 248, 250, 252 are configured as branch lines in the illustrated embodiment, each having an inlet 270 connected to the motor coolant supply line 254 upstream of the motor coolant control valve 264, and an outlet 272 connected to the compressor housing 216 to deliver the coolant to the first, second, and third coolant flow channels 236, 238, 240. In other embodiments, the inlet 270 of one or more of the bearing coolant supply lines 248, 250, 252 may be connected to the coolant source 262. In yet other embodiments, the motor coolant supply line 254 may be configured as a branch circuit extending off of one of the bearing coolant supply lines 248, 250, 252.

The illustrated cooling circuit 204 also includes a shutoff valve 274 on the main coolant supply line (i.e., the motor coolant supply line 254) to enable coolant flow to the entire cooling circuit to be shut off in order to isolate the compressor from the rest of the system, (e.g., for service). The shutoff valve 274 may be omitted in other embodiments.

In the illustrated embodiment, the bearing coolant supply lines 248, 250, 252 are free of shutoff valves or other devices that would cut the supply of coolant through the bearing coolant supply lines 248, 250, 252. Thus, while the cooling circuit 204 is active, the bearing coolant supply lines 248, 250, 252 are configured to continuously supply coolant to the compressor housing 216, irrespective of a position of the motor coolant control valve 264. In this way, the bearings of the compressor 202 are continuously supplied with coolant during operation to facilitate maintaining bearings within a suitable range of operating temperatures. The bearing coolant flow paths—including the bearing coolant supply lines 248, 250, 252 and the associated coolant flow channels 236, 238, 240 defined within the compressor housing 216—can include flow restrictors along the flow path to restrict or otherwise limit the flow of coolant therethrough. The flow restrictors may be included in the bearing coolant supply lines 248, 250, 252 and/or may be integrated into the compressor housing 216 (e.g., as metering orifices along the coolant flow channels). In some embodiments, for example, one or more of the coolant inlet ports 244 associated with the bearing coolant flow channels 236, 238, 240 includes a metering orifice to control the flow of coolant therethrough.

The coolant return line 256 is connected to the compressor housing 216 to receive coolant from the coolant flow channels 236, 238, 240, 242 and return coolant to a low-pressure side of the compressor 202. The low pressure side of the compressor 202 generally refers to portions of the compressor 202 and the refrigeration circuit of which the compressor 202 is a part that precede the compression stages of the compressor 202 (i.e., the first stage 206 and the second stage 208). The low pressure side of the compressor 202 may include, for example and without limitation, a portion of the compressor 202 upstream of the first stage impeller 226, an inlet to the first stage 206, and the suction line 212 connected to the inlet of the first stage 206.

The coolant return line 256 can include any suitable fluid conduit (rigid and/or flexible) that enables delivery of coolant from the compressor housing 216 to the lower pressure side of the compressor 202. Suitable conduits include, for example and without limitation, pipes, hoses, tubes, and combinations thereof. In some embodiments, the coolant return line 256 is constructed of metal tubing, such as copper tubing. In other embodiments, the coolant return line 256 is constructed of other materials. In some embodiments, the coolant return line is formed as part of the housing 216. Additionally, in some embodiments, the return line 256 may include a flat portion or section to facilitate mounting the temperature sensor 258.

An inlet 276 of the coolant return line 256 is connected to the common coolant outlet port 246, and an outlet 278 of the coolant return line 256 is connected to the low-pressure side of the compressor 202. Coolant at the coolant source 262 (e.g., the condenser 104) is generally at a higher pressure than the low pressure side of the compressor 202. As a result, a pressure differential exists between coolant at the coolant source 262 and the low pressure side of the compressor 202, which facilitates driving coolant through the cooling circuit 204.

The coolant return line 256 is connected to the common coolant outlet port 246 and receives coolant from each of the coolant flow channels 236, 238, 240, 242 after the coolant absorbs heat from the motor 234 and/or the bearings 220, 222, 224. As noted above, at least one of the coolant flow channels 236, 238, 240, 242 can be arranged such that coolant flows through the at least one coolant flow channel, in series, across at least one of the bearings 220, 222, 224, through the motor 234, and to the common coolant outlet port 246. In the illustrated embodiment, for example, the third cooling flow channel 240 is arranged so the coolant flows, in series, across the second radial bearing 222, through the motor 234, and to the common coolant outlet port 246. As a result, coolant that flows through the coolant return line 256 has absorbed heat from at least one of the bearings 220, 222, 224 and the motor 234, even when the motor coolant control valve 264 is in an off position.

The temperature sensor 258 is connected to the coolant return line 256 to detect at least one of a temperature of the coolant return line 256 and a temperature of coolant within the coolant return line 256. The temperature sensor 258 can include any suitable temperature sensor that enables the cooling circuit 204 to function as described herein, including, for example and without limitation, thermistors, thermocouples, resistance temperature detectors (RTDs), thermal switches, and combinations thereof. In some embodiments, the temperature sensor 258 includes a negative temperature coefficient thermistor.

Figure 3:
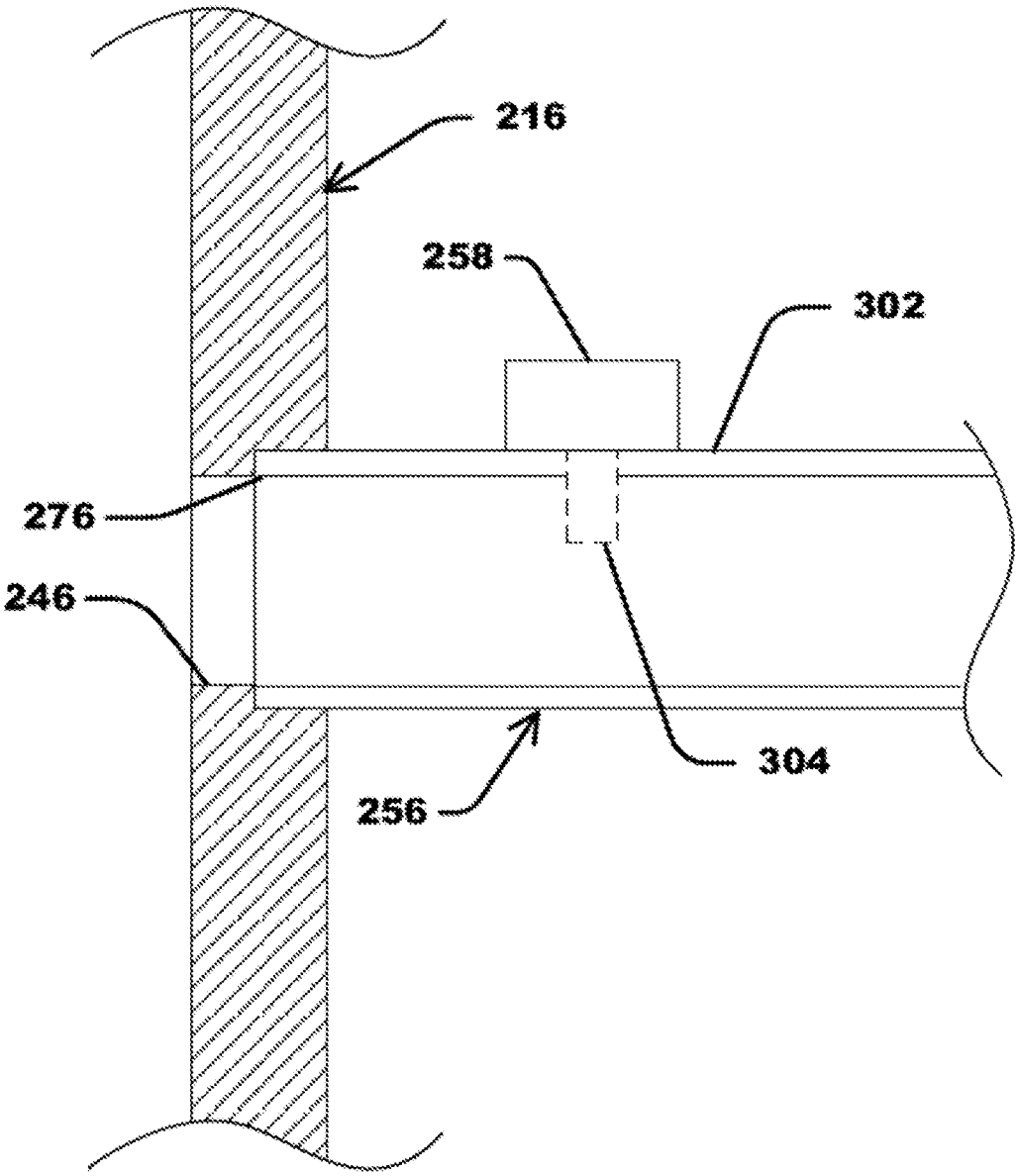
FIG. 3 is a sectional view of a portion of the compressor cooling system shown in FIG. 2, showing a temperature sensor connected to a coolant return line.

The temperature sensor 258 of this embodiment is located completely external of the compressor housing 216 and the coolant return line 256 and is configured to detect a temperature of the coolant return line 256. As illustrated in FIG. 3, for example, the temperature sensor 258 is connected to an external surface 302 of the coolant return line 256 and is configured to detect a temperature of the external surface 302. In other embodiments, the temperature sensor 258 may include a probe 304 (shown in dashed lines in FIG. 3) that extends within the coolant return line 256 to detect a temperature of coolant flowing through the coolant return line 256.

The controller 260 is connected to the temperature sensor 258 and the motor coolant control valve 264 and is configured to control operation of the motor coolant control valve 264 (e.g., by opening, closing, or varying a position of the motor coolant control valve 264). In some embodiments, for example, the controller 260 is configured to control the motor coolant control valve 264 based on the temperature detected by the temperature sensor 258 to control the supply of coolant to the compressor housing 216. For example, the controller 260 may receive a signal from the temperature sensor 258 indicative of a temperature detected by the temperature sensor 258, compare the detected temperature to one or more temperature set points, and control the motor coolant control valve 264 based on the detected temperature.

The controller 260 generally includes any suitable computer and/or other processing unit, including any suitable combination of computers, processing units and/or the like that may be communicatively connected to one another and that may be operated independently or in connection within one another (e.g., controller 260 may form all or part of a controller network). Controller 260 may include one or more modules or devices, one or more of which is enclosed within the compressor 202, or may be located remote from the compressor 202. The controller 260 includes a processor 280, a memory device 282, and a communication interface 284 configured to perform a variety of computer-implemented functions (e.g., performing the calculations, determinations, and functions disclosed herein). Although a single processor 280, memory 282, and communication interface 284 are illustrated, the controller may include more than one of each component and may include additional components.

As used herein, the term "processor" refers not only to integrated circuits, but also refers to a controller, a microcontroller, a microcomputer, a programmable logic controller (PLC), an application specific integrated circuit, and other programmable circuits. Additionally, memory device (s) 282 of controller 260 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 282 may generally be configured to store suitable computer-readable instructions that, when implemented by the processor(s), configure or cause controller 260 to perform various functions described herein including, but not limited to, controlling the motor coolant control valve 264 and/or various other suitable computer-implemented functions.

The communication interface 284 enables the controller 260 to communicate with remote devices and systems, such as sensors, valve control systems, safety systems, remote computing devices, other components of the system, and the like. The communication interface 284 may be a wired or wireless communications interface that permits the controller to communicate with the remote devices and systems directly or via a network. Wireless communication interfaces may include a radio frequency (RF) transceiver, a Bluetooth® adapter, a Wi-Fi transceiver, a ZigBee® transceiver, an infrared (IR) transceiver, a near field communication (NFC) transceiver, and/or any other device and communication protocol for wireless communication. (Bluetooth is a registered trademark of Bluetooth Special Interest Group of Kirkland, Washington; ZigBee is a registered trademark of the ZigBee Alliance of San Ramon, California.) Wired communication interfaces may use any suitable wired communication protocol for direct communication including, without limitation, USB, RS232, I2C, SPI, analog, and proprietary I/O protocols. In some embodiments, the wired communication interface 284 may include a wired network adapter allowing the computing device to be coupled to a network, such as the Internet, a local area network (LAN), a wide area network (WAN), a mesh network, and/or any other network to communicate with remote devices and systems via the network.

The controller 260 and/or components of controller 260 may be integrated or incorporated within other components of the cooling circuit 204 and/or a refrigeration system within which the cooling circuit 204 is incorporated. For example, the controller 260 may be incorporated within the motor coolant control valve 264 and/or a system controller that controls other functions and operations of the compressor 202 and the refrigeration system.

The controller 260 can be configured to control the motor coolant control valve 264 based solely on temperatures detected by the temperature sensor 258. As noted above, for example, the temperature sensor 258 is configured to detect a temperature of coolant within the coolant return line 256 or the coolant return line 256 itself, which receives coolant from each of the coolant flow channels 236, 238, 240, 242. Further, at least one of the coolant flow channels (e.g., the third coolant flow channel 240) is arranged such that coolant flows across at least one of the bearings 220, 222, 224 and the motor 234 before reaching the common coolant outlet port 246. Consequently, coolant flowing through the coolant return line 256 has absorbed heat from both the compressor bearings 220, 222, 224 and the motor 234. Thus, the temperature of coolant within the coolant return line 256 and the temperature of the coolant return line 256 provides an indication of the temperature of the bearings 220, 222, 224 and the motor 234, and can be used to determine when additional coolant at the motor 234 is needed (and thus the motor coolant control valve 264 should be opened), or when no additional coolant at the motor 234 is needed (and thus the motor coolant control valve 264 should be closed).

The controller 260 can be configured to receive a signal from the temperature sensor 258 indicative of a temperature detected by the temperature sensor 258 and compare the detected temperature to one or more temperature set points (stored in the controller memory 282, for example). Based on the comparison, the controller 260 can be configured to open the motor coolant control valve 264, thereby permitting additional coolant flow through the motor coolant supply line 254 and to the motor 234, or close the motor coolant control valve 264, thereby reducing coolant flow through the motor coolant supply line 254 and to the motor 234. "Opening" and "closing" the motor coolant control valve 264 can refer to absolute opening and closing (i.e., completely opening and closing of the valve), or relative opening and closing of the valve (e.g., opening the valve more than it already is, or closing the valve more than it already is). Moreover, the controller 260 opens or closes the motor coolant control valve 264 by commanding the motor coolant control valve 264 to open or close (e.g., by sending a control signal to the motor coolant control valve 264, by applying a particular voltage to the motor coolant control valve 264, by transmitting an instruction to the motor coolant control valve 264, or the like).

The one or more temperature set points can be empirically determined prior to operation, for example, by comparing a measured temperature of the motor with the temperature detected by the temperature sensor 258. In some embodiments, for example, a single temperature set point can be determined based on the temperature detected by the temperature sensor when the measured temperature of the motor 234 reaches a maximum allowable operating temperature. In this case, the temperature set point may be set as a temperature that is a certain number of degrees below the temperature detected by temperature sensor 258 (e.g., 10° C., 20° C., 30° C., etc.) when the measured temperature of the motor 234 is at the maximum allowable operating temperature. In embodiments that use a single temperature set point, the controller 260 can open the motor coolant control valve 264 when the temperature detected by the temperature sensor 258 is above the temperature set point and close the motor coolant control valve 264 when the temperature detected by the temperature sensor 258 is below the temperature set point.

The controller 260 may alternatively, or additionally control the motor coolant control valve 264 based on more than a single temperature set point, such as two temperature set points. In such embodiments, two temperature set points may define a window or range of suitable temperatures. In such embodiments, the controller 260 can open the motor coolant control valve 264 when the temperature detected by the temperature sensor 258 is above a first, upper temperature set point, and close the motor coolant control valve 264 when the temperature detected by the temperature sensor 258 is below a second, lower temperature set point.

Figure 4:
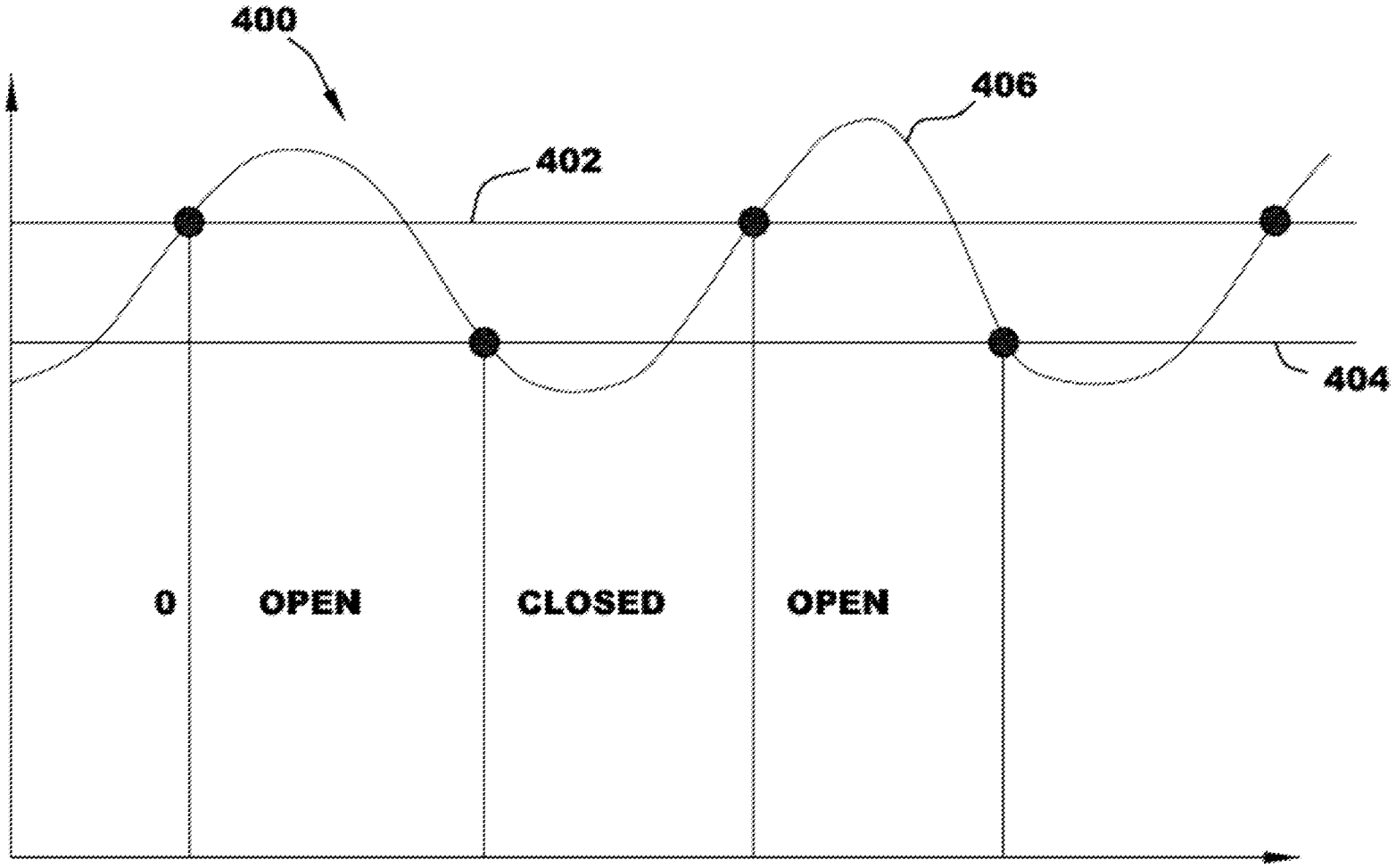
FIG. 4 is a graph illustrating operation of a coolant control valve of the compressor cooling system shown in FIG. 2 based on two temperature set points.

FIG. 4 is a simplified graph 400 illustrating operation of the motor coolant control valve 264 based on two temperature set points, indicated by lines 402 and 404. The first and second temperature set points 402 and 404 generally define a temperature range above which the motor coolant control valve 264 is opened, and below which the motor coolant control valve 264 is closed. The temperature range may be any suitable temperature range that enables the compressor 202 to function as described herein including, for example and without limitation, 2° F., 5° F., 10° F., 15° F., 20° F., 25° F., 30° F., 35° F., 40° F., 50° F., or greater. The temperature detected by the temperature sensor 258 is illustrated by curve 406 in FIG. 4. As shown by FIG. 4, when the detected temperature 406 exceeds the first temperature set point 402, the controller 260 opens the motor coolant control valve 264 to supply additional coolant to the motor 234. The additional coolant supplied to the motor 234 results in the temperature of coolant in the coolant return line 256 and the temperature of the coolant return line 256 initially increasing as additional heat is picked up from the motor 234 (e.g., from the stator), and subsequently decreasing, resulting in the detected temperature 406 decreasing. Although the temperature increase is illustrates as increasing at a rate that does not change immediately after the motor coolant control valve 264 is opened in FIG. 4, the detected temperature 406 may initially increase at a faster rate after the motor coolant control valve 264 is opened as additional heat that was not previously contributing much/any to the detected temperature 406 is picked up from the motor 234. When the detected temperature 406 decreases to a temperature below the second temperature set point 404, the controller 260 closes the motor coolant control valve 264, reducing coolant flow to the motor 234. The temperature of coolant at the coolant return line 256 increases as a result, as shown in FIG. 4. When the detected temperature 406 reaches a temperature that exceeds the first temperature set point 402 again, the controller 260 again opens the motor coolant control valve 264 to supply additional coolant to the motor 234 and the cycle repeats. Other embodiments may control the motor coolant control valve 264 based on different temperature measurements, one or more temperature measurements in addition to the temperature detected by the temperature sensor 258, or according to any other suitable control scheme.

As mentioned above, the controller 260 opens or closes the motor coolant control valve 264 by commanding the motor coolant control valve 264 to open or close (e.g., by sending a control signal to the motor coolant control valve 264, by applying a particular voltage to the motor coolant control valve 264, by transmitting an instruction to the motor coolant control valve 264, or the like). In the example embodiments, the motor coolant control valve 264 does not include a sensor to detect when the motor coolant control valve 264 is open or closed. Thus, the motor coolant control valve 264 is not able to provide feedback to the controller 260 to confirm that the motor coolant control valve 264 actually opened in response to the command from the controller 260. Even in embodiments in which the motor coolant control valve 264 is able to communicate to the controller 260, the motor coolant control valve 264 can only confirm that it received the command from the controller 260 and functioned as commanded. It cannot accurately report whether or not its valve actually opened as commanded.

The controller 260 is programmed to determine whether or not the motor coolant control valve 264 opened based on the detected temperature from the temperature sensor 258. Specifically, the controller determines if the motor coolant control valve 264 opened based on the detected temperature from the temperature sensor 258 at the time that the controller 260 commanded the motor coolant control valve 264 to open and the detected temperature from the temperature sensor 258 after the controller 260 commanded the motor coolant control valve 264 to open.

Figure 5A:
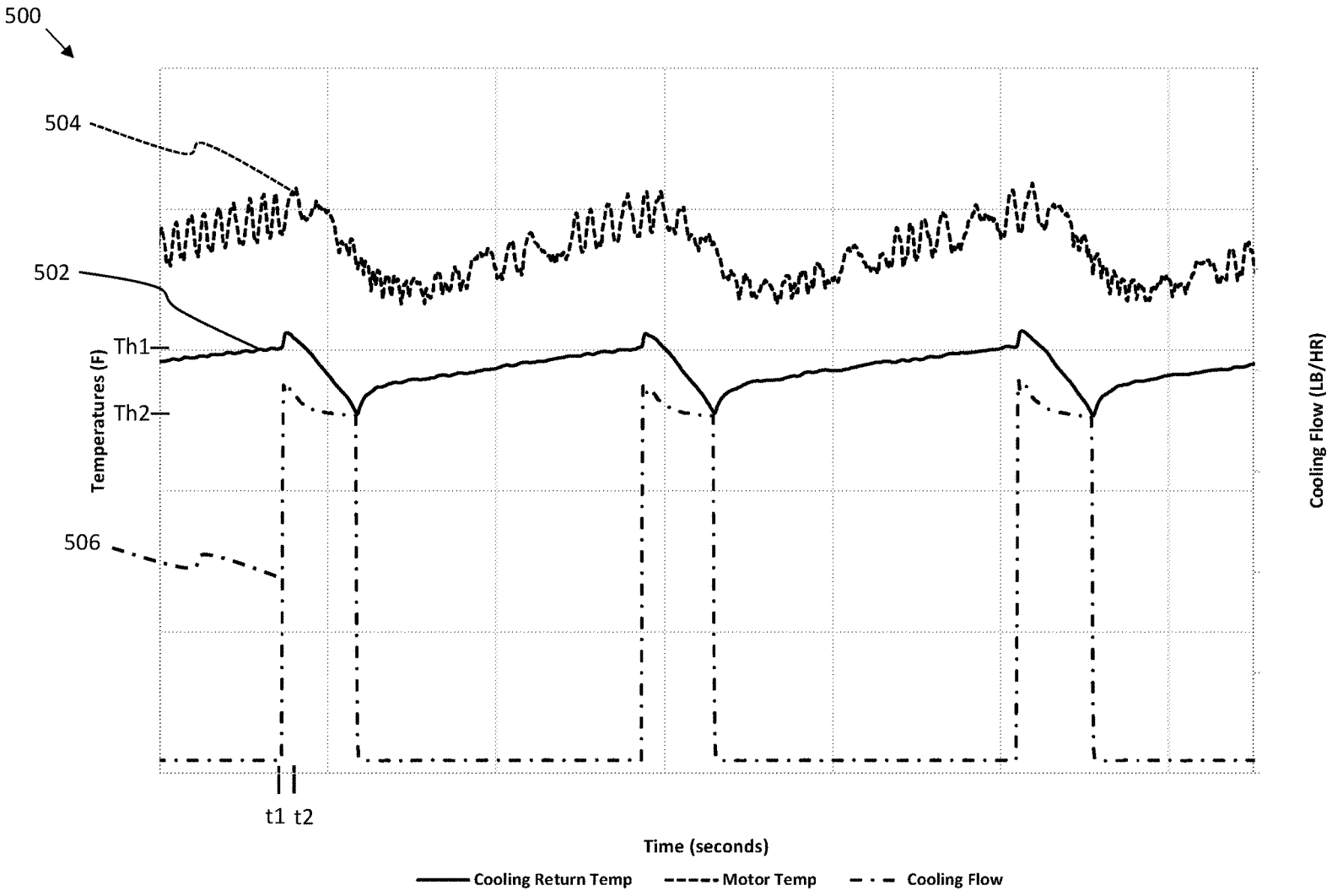
FIG. 5A is a graph of the coolant return temperature, the temperature of the motor in the compressor, and the flow of coolant through the coolant return line as a function of time in the system shown in FIG. 2.

FIG. 5A is a graph 500 of the coolant return temperature 502 detected by the sensor 258 (in ° F.), the temperature 504 of the motor 234 (in ° F.), and the flow 506 of coolant (in pounds per hour—LB/HR) through the coolant return line 256, all as a function of time. The coolant flow 506 is always non-zero because of the bearing coolant supply lines 248, 250, 252 continuously receiving a supply of coolant to the compressor housing 216, irrespective of a position of the motor coolant control valve 264. When the coolant return temperature 502 exceeds a temperature threshold (Th1), the controller 260 commands the motor coolant control valve 264 to open, the motor coolant control valve 264 opens, coolant flow 506 increases to cool the motor and eventually lower the coolant return temperature 502 below a second threshold (Th2), the controller 260 commands the motor coolant control valve 264 to close, the motor coolant control valve 264 closes, and the coolant flow 506 returns to the low level flow providing coolant primarily to the bearings of the compressor.

Figure 5B:
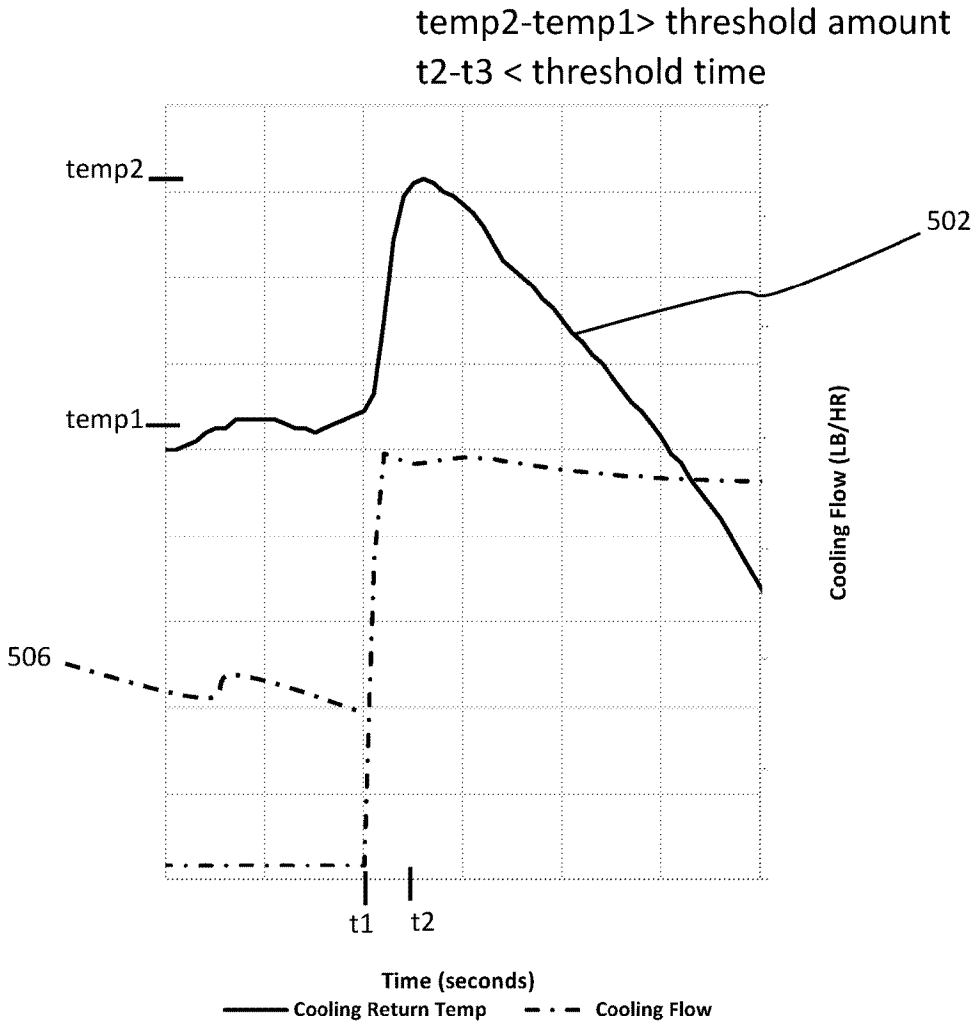
FIG. 5B is an expanded view of a portion of the graph in FIG. 5A showing the coolant return temperature and the coolant flow for a one minute interval during which the motor coolant control valve opens.
Figure 5C:
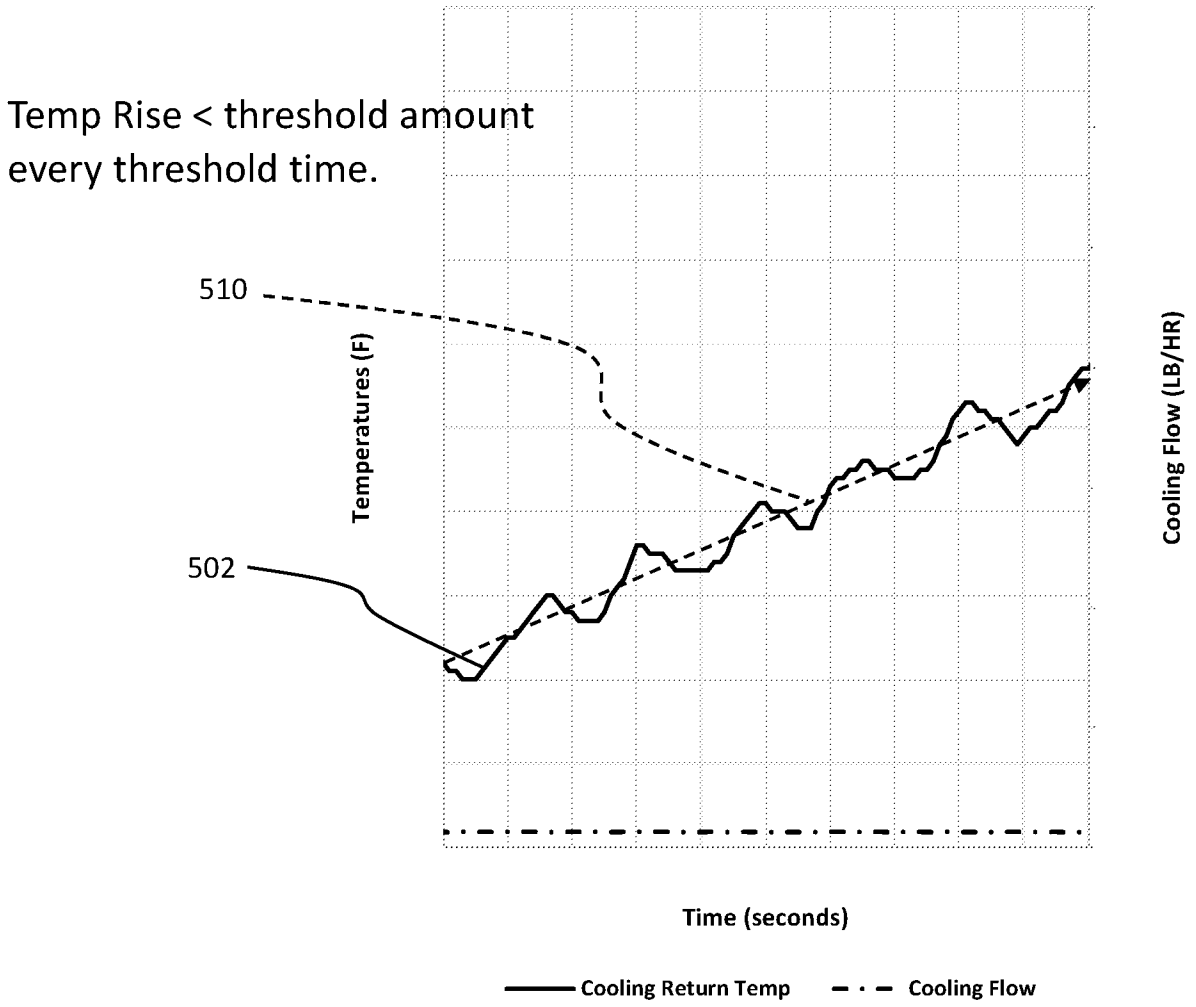
FIG. 5C. is an expanded view of another portion of the graph in FIG. 5A showing the coolant return temperature and the coolant flow for a specific interval when the motor coolant control valve is closed.

FIG. 5B is an expanded view of a portion of the graph 500 showing the coolant return temperature 502 and the coolant flow 506 for about one minute including times t1 and t2. Sometime at or before t1 seconds, the controller 260 commands the motor coolant control valve 264 to open. At t1 seconds, the motor coolant control valve 264 opens and coolant flow 506 increases significantly. At t1 seconds, the coolant return temperature 502 is about temperature temp1, and after the motor coolant control valve 264 opens and coolant begins to flow to the motor, the coolant return temperature 502 climbs rapidly to temp2 by time t2 before beginning to decrease. The time from t1 to t2 (At) is less than a threshold time and the temperature increase (Tempe) from temp1 to temp2 is more than a threshold amount. In one example, the threshold time is 15 seconds and the threshold temperature is 3° F. This temperature spike can be seen each time the motor coolant control valve 264 opens in FIG. 5A. If the motor coolant control valve 264 did not open at time t1, the coolant return temperature 502 would have continued to increase at a much slower rate. FIG. 5C is an expanded view of another portion of the graph 500 showing the coolant return temperature 502 and the coolant flow 506 for an interval of about one hundred seconds. During this time interval, the motor coolant control valve 264 is closed and the coolant return temperature 502 increases at a slower and fairly consistent rate shown by the trend line 510. The trend line 510 shows the coolant return temperature 502 increasing much less than tamp ° F. in the same amount of time that it takes the temperature to increase from temp1 to temp2 in FIG. 5B. For example, in one embodiment, the coolant temperature 502 in FIG. 5C is increasing much less than 3° F. every 15 seconds. In this example, the temperature 502 when the motor coolant control valve 264 is closed takes more than ten times Δt seconds to increase by Δtemp ° F. This slow increase contrasts sharply with the Δtemp in Δt seconds increase in the coolant return temperature 502 seen when the motor coolant control valve 264 opens at time t1 in FIG. 5B. In some embodiments, the controller 260 may look for a temperature increase of more than a threshold amount in less than a threshold time after time t1 to identify the spike, which then is seen as an indication that the motor coolant control valve 264 opened. In some embodiments, the threshold amount is 3° F. and the threshold time is 15 seconds. Other embodiments may use any other suitable threshold amounts and/or times.

The controller 260 is programmed to use the different rates of increase in coolant return temperature 502 to determine if the motor coolant control valve 264 actually opened when commanded. Generally, the controller 260 compares the coolant return temperature 502 at about the time that the controller 260 commands the motor coolant control valve 264 to open to subsequent samples of the coolant return temperature 502 to look for the spike (i.e., the high rate of change) in the coolant return temperature 502. If the spike is found, the controller 260 determines that the motor coolant control valve 264 opened as commanded. If the spike is not found, the controller 260 determines that the motor coolant control valve 264 did not open and remedial action may be taken by the controller.

In some embodiments, the remedial action is a warning or alert. The warning may be a human cognizable alert, such as an audible or visible alarm output on a human cognizable output device, such as a speaker, light, display or the like. In other embodiments, the warning is an electronic warning. The electronic warning may be output to a remote device, such as a mobile phone, a remote computing device, a server, or the like, using communication interface 284. In some embodiments, the electronic warning includes an indication that the motor coolant control valve 264 did not open, the time and date of the failure to open, and any other data that may be useful for system monitoring, diagnostics, and/or maintenance. In some embodiments, the electronic warning is stored in the memory 282 of the controller 260 for later retrieval, such as by a maintenance technician.

The remedial action in the form of a warning or alert may be used to summon a technician to the compressor 202 to diagnose the problem with the compressor 202 and repair the compressor in response to the remedial action. In some embodiments, the warning/alert is sent to a service center or directly to a repair/maintenance technician associated with the system 200 and the compressor 202.

In some embodiments, the remedial action includes attempting again to open the motor coolant control valve 264. After repeating the attempt to open the motor coolant control valve 264, the controller 260 will again monitor the coolant return temperature 502 to determine if the repeated attempt was successful. In some embodiments, the controller repeatedly tries to open the motor coolant control valve 264 until it determines that the motor coolant control valve 264 actually opened, while in other embodiments, a predetermined number of attempts is made before the controller 260 stops attempting to open the motor coolant control valve 264.

To attempt to avoid overheating and potentially damaging the compressor 202, the controller 260 takes remedial action in some embodiments by stopping operation of the compressor 202 when the motor coolant control valve 264 does not open. Some embodiments only take such extreme remedial action when the coolant return temperature 502 exceeds a relatively high threshold temperature or when multiple attempts to open the motor coolant control valve 264 have failed.

The various remedial actions may be combined in any suitable combination as a remedial action taken by the controller 260. For example, the controller 260 may make a second (or more) attempt to open the motor coolant control valve 264, generate an electronic warning that is stored in the memory 282, and generate a human cognizable alert. Moreover, the controller 260 in some embodiments may also shut down the compressor after a certain number of unsuccessful attempts to open the motor coolant control valve 264.

Figure 6:
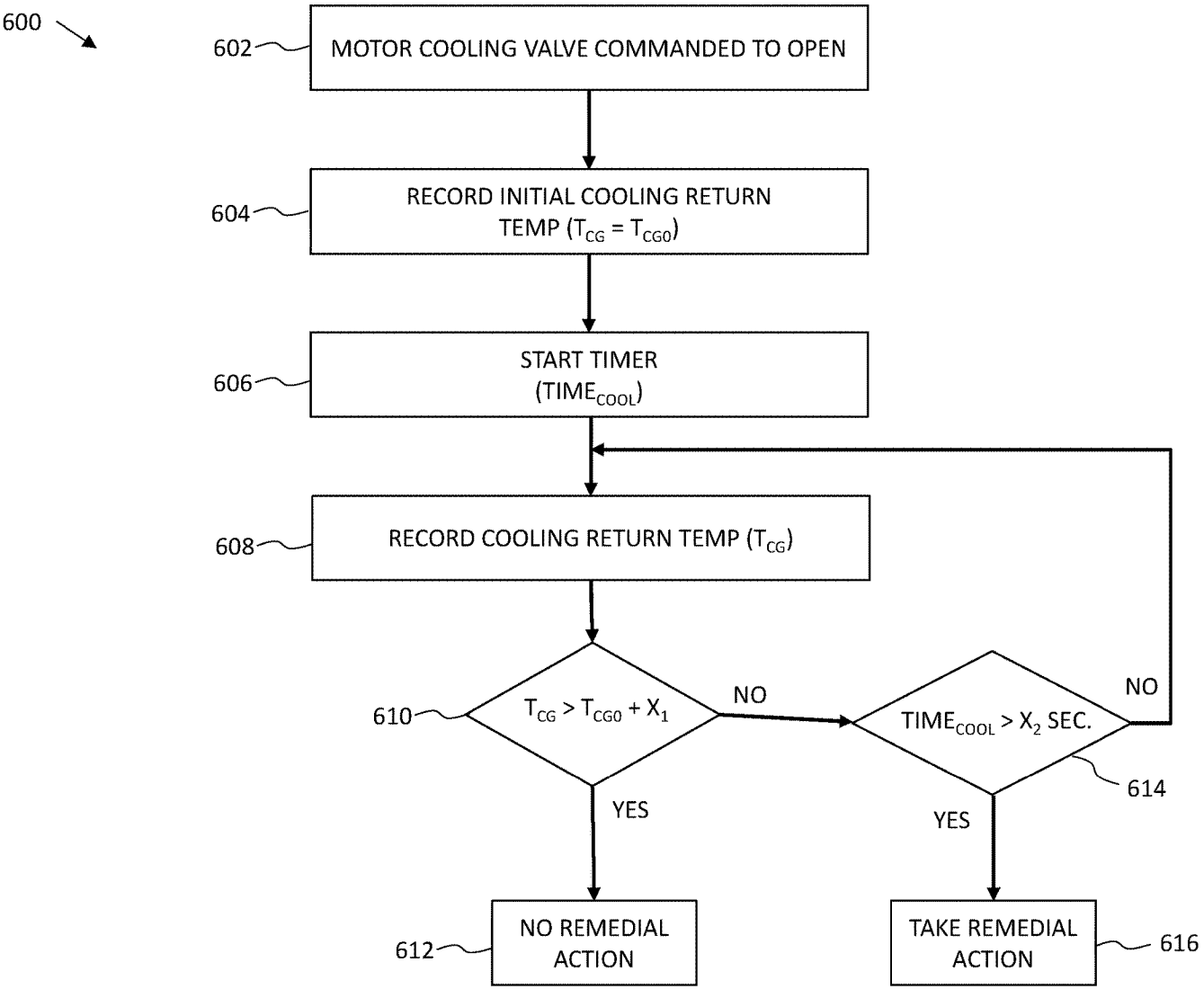
FIG. 6 is a flow diagram of one example method of operating the compressor and the compressor cooling system shown in FIG. 2.

FIG. 6 is a flow diagram of one example method 600 of operating a compressor, such as the compressor 202, by a controller, such as the controller 260. At 602, the controller 260 commands the motor coolant control valve 264 to open to provide a supply of coolant to the motor coolant flow channel 242 at a first time. Also at about the first time, the controller 260 receives a first detection of the cooling return temperature $T_{CG}$ from the sensor 258 and records 604 it as the temperature sensor 258 as the initial cooling return temperature $T_{CG0}$ and starts 606 a timer $TIME_{COOL}$. At second time after the first time, the controller 260 receives a second detection of the cooling return temperature $T_{CG}$ from the sensor 258 and records 608 it.

The controller 260 then determines, based on the first detection and the second detection of the coolant return temperature, if the motor coolant control valve 264 opened at the first time. Specifically, at 610, the controller 260 determines if the current coolant return temperature $T_{CG0}$ (second detection) is greater than the initial cooling return temperature $T_{CG0}$ (first detection) plus a threshold amount $X_1$. The threshold amount $X_1$ is selected to be an amount by which the coolant return temperature will increase in a short time when the motor coolant control valve 264 is opened, but which it will take the coolant return temperature a significantly longer amount of time to increase when the motor coolant control valve 264 stays closed. That is, the threshold amount $X_1$ is selected to identify the initial spike in coolant return temperature that occurs when the motor coolant control valve 264 is opened as opposed to the gradual temperature increase that continues when the motor coolant control valve 264 stays closed. In an example embodiment in a system that produces measurements as shown in FIGS. 5A-5C, for example, the threshold amount $X_1$ may be 3° F. As shown in FIGS. 5B and 5C, the coolant return temperature increases by 3° F. in about three seconds when the motor coolant control valve 264 opens, and in about 85 seconds when the motor coolant control valve 264 remains closed. Moreover, the coolant return temperature increases by more than 3° F. after the motor coolant control valve 264 opens before the temperature starts a consistent decrease and the 3° F. is likely larger than any normal fluctuations in the coolant return temperature. Thus, the coolant return temperature will increase over the initial temperature by at least the 3° F. threshold $X_1$ when the motor coolant control valve 264 opens in the example system long before the coolant return temperature will increase over the initial temperature by the 3° F. threshold $X_1$ when the motor coolant control valve 264 does not open. The threshold $X_1$ may be a predetermined threshold, such as the 3° F. example threshold discussed above, based for example on the historical response of the particular compressor in the particular system, or may be a variable or calculated threshold. For example, the threshold $X_1$ may vary based on one or more of a value of the first detection of the coolant return temperature, a temperature of the motor, and an expected coolant flow rate.

If the controller 260 determines that the current coolant return temperature $T_{CG0}$ (second detection) is greater than the initial cooling return temperature $T_{CG0}$ (first detection) plus the threshold amount $X_1$, the controller takes no remedial action at 612. The controller 260 also stops the timer $TIME_{COOL}$ started at 606 and stops comparing the coolant return temperature to the initial coolant return temperature $T_{CG0}$ plus the threshold $X_1$.

If the controller 260 determines that the current coolant return temperature $T_{CG0}$ (second detection) is not greater than the initial cooling return temperature $T_{CG0}$ (first detection) plus the threshold amount $X_1$, the controller 260 determines 614 if the timer $TIME_{COOL}$ is greater than a time threshold $X_2$ seconds. The time threshold is selected to differentiate the temperature spike that occurs when the motor coolant control valve 264 opens from the slow temperature increase that occurs when the motor coolant control valve 264 does not open. Thus, the temperature threshold is selected to be shorter than the time that it would take the coolant return temperature to increase by the threshold amount $X_1$ if the motor coolant control valve 264 is closed, but longer than the time that it should take the coolant return temperature to increase by the threshold amount X1 when the motor coolant control valve 264 opens. In a system that produces measurements as shown in FIGS. 5A-5C, for example, the coolant return temperature increases by 3° F. in about three seconds when the motor coolant control valve 264 opens, and in about 85 seconds when the motor coolant control valve 264 remains closed. Thus, the time threshold amount $X_2$ may be between about 3 seconds and about 85 seconds. In one example embodiment for such a system, the time threshold amount $X_2$ is about 15 seconds.

If the controller 260 determines at 614 that the timer $TIME_{COOL}$ is greater than the time threshold X: seconds, at 616, the controller 260 takes remedial action as described above. In some embodiments, the controller 260 also stops the timer $TIME_{COOL}$ started at 606 and stops comparing the coolant return temperature to the initial coolant return temperature $T_{CG0}$ plus the threshold $X_1$. If the controller 260 determines at 614 that the timer $TIME_{COOL}$ is not greater than the time threshold $X_2$ seconds, the method returns to 608 and the controller 260 records the current coolant return temperature $T_{CG}$ and repeats the comparisons at 610 and 614 as appropriate.

In another embodiment, a method of operating a compressor system includes controlling the compressor 202 to compress refrigerant and commanding the motor coolant control valve 264 to open at a first time to provide a supply of coolant to a motor coolant flow channel 242 that delivers coolant to a motor 234 of the compressor. A first detection of the coolant return temperature is received at the first time from the temperature sensor 258 connected to the coolant return line 256 that receives coolant from the motor coolant flow channel 242 and returns coolant to the refrigerant inlet or another portion of the compressor 202. Additional detections of the coolant return temperature are periodically received from the temperature sensor 258. For each additional detection, it is determined if the additional detection exceeds a sum of the first detection and a threshold amount. The motor coolant control valve 264 is determined to have opened at the first time and determining if the additional detection exceeds the sum is stopped when one of the additional detections exceeds the sum of the first detection and the threshold amount. The motor coolant control valve 264 is determined not to have opened at the first time and determining if the additional detection exceeds the sum is stopped when none of the additional detections exceeds the sum of the first detection and the threshold amount and a predetermined length of time has passed after the first time. A warning is generated when the motor coolant control valve 264 is determined not to have opened at the first time.

When the flow of additional coolant to the compressor 202 is not needed and the motor coolant control valve 264 is closed, coolant flow problems may still occur and may be detected. As mentioned above, the coolant flow 506 is always non-zero because of the bearing coolant supply lines 248, 250, 252 continuously receiving a supply of coolant to the compressor housing 216, irrespective of a position of the motor coolant control valve 264. In various example embodiments, the controller 260 is configured to determine if there is a problem with coolant flow to the compressor (e.g., coolant flow through the bearing coolant supply lines or the bearing coolant flow lines) based at least in part on the temperatures of the internal compressor components (e.g., the temperatures receive from the bearing temperature sensors and the motor temperature sensor). The problems that may be identified include too little or no coolant flow and too much coolant flow.

With respect to too little coolant flow, when the compressor 202 is operating, but the compressor does not yet need motor cooling, the cooling return temperature TCG from the sensor 258 should be close to the temperatures of internal compressor components, such as the temperatures of the radial bearings ($T_{RB1}$ and $T_{RB2}$), thrust bearing ($T_{TB}$), and the motor ($T_M$). If there is a large temperature difference between the cooling return temperature and the internal compressor temperatures, cooling media may not be flowing to the compressor. Various example embodiments of the present disclosure monitor this temperature difference and take remedial action when needed.

In some embodiments, the remedial action is a warning or alert. The warning may be a human cognizable alert, such as an audible or visible alarm output on a human cognizable output device, such as a speaker, light, display or the like. In other embodiments, the warning is an electronic warning. The electronic warning may be output to a remote device, such as a mobile phone, a remote computing device, a server, or the like, using communication interface 284. In some embodiments, the electronic warning includes an indication of the detected problem, the data relied on (e.g., the specific monitored temperatures), the time and date of occurrence, and any other data that may be useful for system monitoring, diagnostics, and/or maintenance. In some embodiments, the electronic warning is stored in the memory 282 of the controller 260 for later retrieval, such as by a maintenance technician.

The remedial action in the form of a warning or alert may be used to summon a technician to the compressor 202 to diagnose the problem with the compressor 202 and repair the compressor in response to the remedial action. In some embodiments, the warning/alert is sent to a service center or directly to a repair/maintenance technician associated with the system 200 and the compressor 202.

In some embodiments, the remedial action includes attempting to remedy the problem, such as by attempting to turn on or restart flow of coolant to the bearings. For example, the controller 260 may attempt to open the shutoff valve 274 on the main coolant supply line to ensure that it is open. Alternatively, the controller 260 may cycle the shutoff valve 274 closed and then open to attempt to remedy the problem in some embodiments. After attempting to remedy the problem, the controller 260 will again monitor the coolant return temperature 502 and the internal compressor temperatures to determine if the attempt was successful. In some embodiments, the controller repeatedly tries to remedy the problem until it is remedied, while in other embodiments, a predetermined number of attempts is made before the controller 260 stops attempting to remedy the problem.

To attempt to avoid overheating and potentially damaging the compressor 202, the controller 260 takes remedial action in some embodiments by stopping operation of the compressor 202. Some embodiments only take such extreme remedial action when the coolant return temperature 502 exceeds a relatively high threshold temperature or when multiple attempts to remedy the problem have failed.

The various remedial actions may be combined in any suitable combination as a remedial action taken by the controller 260. For example, the controller 260 may try to remedy the problem, generate an electronic warning that is stored in the memory 282, and generate a human cognizable alert. Moreover, the controller 260 in some embodiments may also shut down the compressor after a certain number of unsuccessful attempts to remedy the problem.

Figure 7:
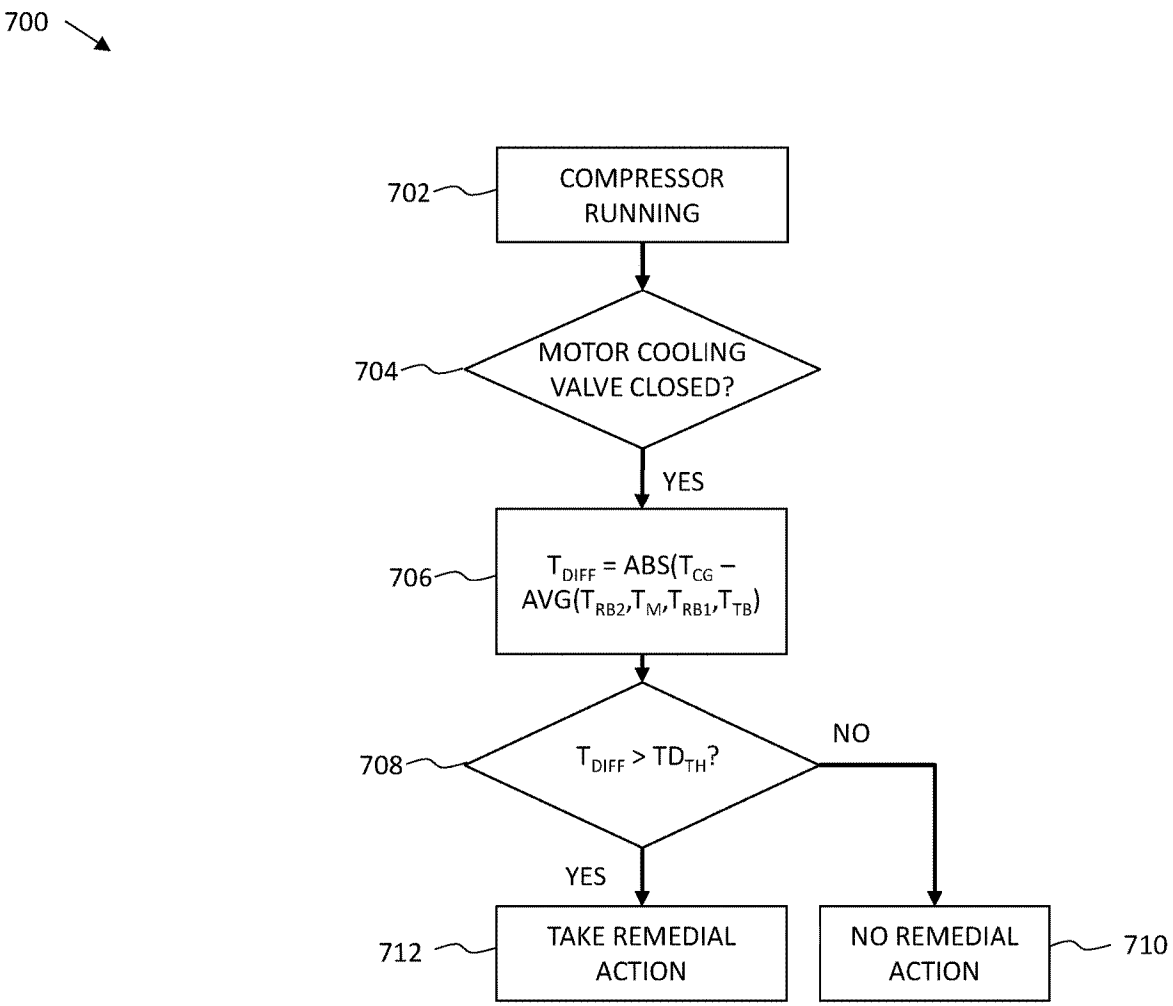
FIG. 7 is a flow diagram of another example method of operating the compressor and the compressor cooling system shown in FIG. 2.

FIG. 7 is a flow diagram of one such example method 700 of operating a compressor, such as the compressor 202, by a controller, such as the controller 260. At 702, the compressor 202 is running. At 704, the controller 260 determines if the motor coolant control valve 264 is closed. If the motor coolant control valve 264 is not closed, the controller exits the method 700 or returns to 702.

If the motor coolant control valve 264 is closed, at 706 the controller 260 determines the temperature difference between the coolant return temperature and the internal components of the compressor 202. Specifically, the controller 260 calculates the temperature difference ($T_{DIFF}$) as the absolute value of the difference between the coolant return temperature $T_{CG}$ from the sensor 258 and the average of the temperature $T_M$ of the motor 234, the temperature $T_{RB1}$ of the first radial bearing 220, the temperature $T_{RB2}$ of the second radial bearing 222, and the temperature Tre of the thrust bearing 224.

At 708, the controller 260 compares the calculated temperature differential $T_{DIFF}$ to a temperature differential threshold $TD_{TH}$. The temperature differential threshold $TD_{TH}$ is selected to correspond to a larger than normal difference between the coolant return temperature and the internal components of the compressor 202. The value of the temperature differential threshold $TD_{TH}$ may be based on historical operational data, experimentation, simulation, or the like. In the example embodiment, the temperature differential threshold $TD_{TH}$ is a predetermined, fixed threshold. In other embodiments, the temperature differential threshold $TD_{TH}$ may be a variable or calculated threshold.

If the calculated temperature differential $T_{DIFF}$ is not greater than the temperature differential threshold $TD_{TH}$, at 710, the controller 260 does not take any remedial action. The controller may exit the method 700 or return to 702 in various embodiments. If the calculated temperature differential $T_{DIFF}$ is greater than the temperature differential threshold $TD_{TH}$, the controller takes remedial action at 712. The remedial action may be any of the remedial actions discussed above, or any other suitable remedial action.

With respect to the problem of too much coolant flow, if there is too much cooling to the compressor 202 during operation, there is a risk of flooding the compressor with liquid refrigerant. To help avoid this possibility, the controller will monitor the temperatures of internal compressor components, such as the temperatures of the radial bearings ($T_{RB1}$ and $T_{RB2}$), thrust bearing ($T_{TB}$), and the motor ($T_M$), and will take remedial action if the internal compressor temperatures are below the saturated temperature of the compressor 202.

In some embodiments, the remedial action is a warning or alert. The warning may be a human cognizable alert, such as an audible or visible alarm output on a human cognizable output device, such as a speaker, light, display or the like. In other embodiments, the warning is an electronic warning. The electronic warning may be output to a remote device, such as a mobile phone, a remote computing device, a server, or the like, using communication interface 284. In some embodiments, the electronic warning includes an indication of the detected problem, the data relied on (e.g., the specific monitored temperatures and calculated saturation temperature), the time and date of occurrence, and any other data that may be useful for system monitoring, diagnostics, and/or maintenance. In some embodiments, the electronic warning is stored in the memory 282 of the controller 260 for later retrieval, such as by a maintenance technician.

The remedial action in the form of a warning or alert may be used to summon a technician to the compressor 202 to diagnose the problem with the compressor 202 and repair the compressor in response to the remedial action. In some embodiments, the warning/alert is sent to a service center or directly to a repair/maintenance technician associated with the system 200 and the compressor 202.

In some embodiments, the remedial action includes attempting to remedy the problem, such as by attempting to restrict the flow of coolant to the bearings. For example, the controller 260 may attempt to close or partially close the shutoff valve 274 on the main coolant supply line.

To attempt to avoid flooding the compressor with liquid refrigerant and potentially damaging the compressor 202, the controller 260 takes remedial action in some embodiments by stopping operation of the compressor 202. Some embodiments only take such extreme remedial action when multiple attempts to remedy the problem have failed.

The various remedial actions may be combined in any suitable combination as a remedial action taken by the controller 260. For example, the controller 260 may try to remedy the problem, generate an electronic warning that is stored in the memory 282, and generate a human cognizable alert. Moreover, the controller 260 in some embodiments may also shut down the compressor after a certain number of unsuccessful attempts to remedy the problem.

Figure 8:
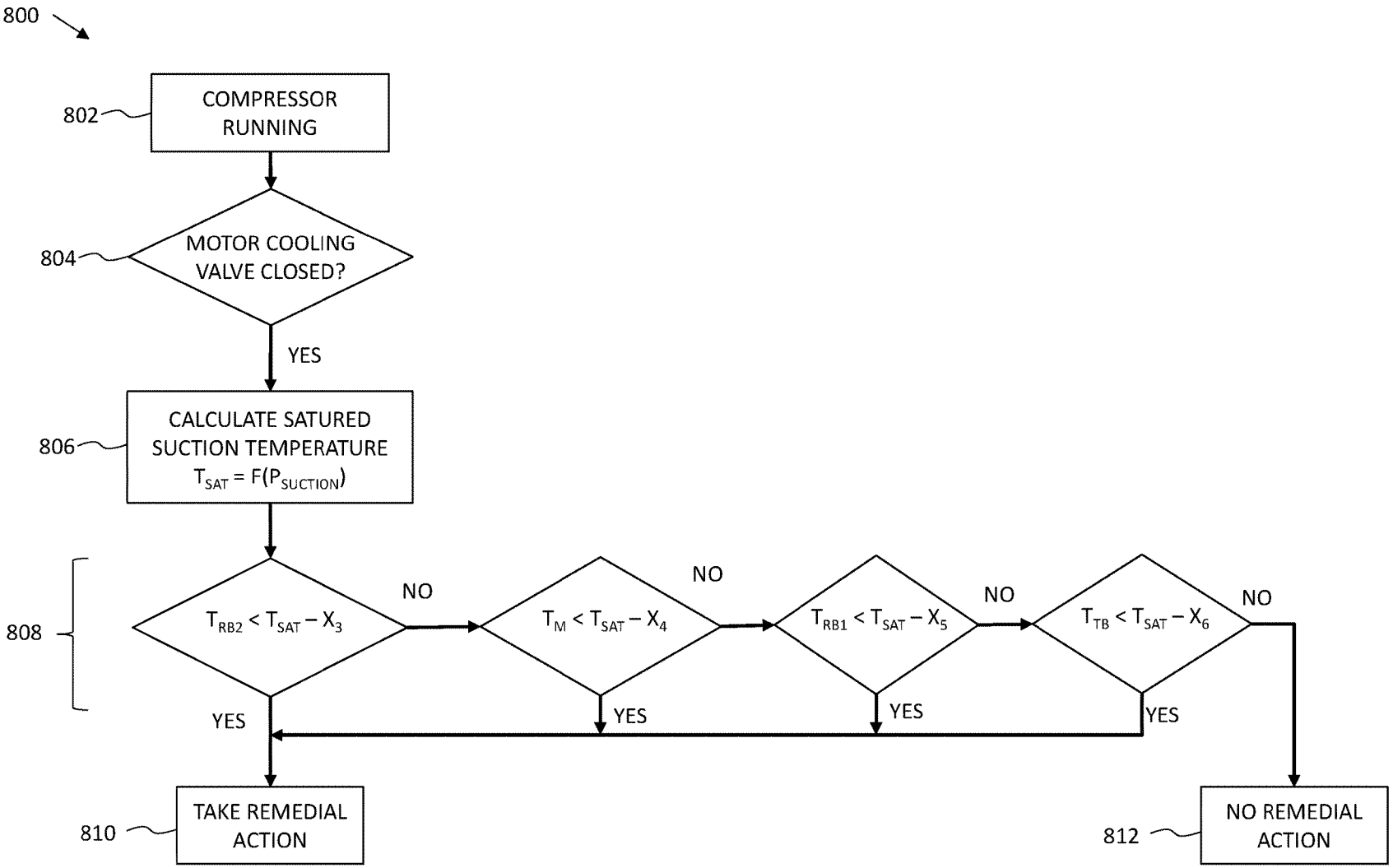
FIG. 8 is a flow diagram of another example method of operating the compressor and the compressor cooling system shown in FIG. 2.

FIG. 8 is a flow diagram of another example method 800 of operating a compressor, such as the compressor 202, by a controller, such as the controller 260 to avoid flooding the compressor with refrigerant. At 802, the compressor 202 is running. At 804, the controller 260 determines if the motor coolant control valve 264 is closed. If the motor coolant control valve 264 is not closed, the controller exits the method 800 or returns to 802.

If the motor coolant control valve 264 is closed, at 806 the controller 260 determines the saturated suction temperature $T_{SAT}$ based on the suction pressure. The saturated suction temperatures may be calculated by the controller 260, retrieved (such as from a lookup table), interpolated from known operating points, or the like.

At 708, the controller 260 compares the temperature $T_{RB2}$ of the second radial bearing 222, the temperature $T_M$ of the motor 234, the temperature $T_{RB1}$ Of the first radial bearing 220, and the temperature $T_{TB}$ of the thrust bearing 224 to the saturated suction temperature $T_{SAT}$ less a margin $X_3$, $X_4$, $X_5$, or $X_6$. The order of the comparisons in 808 is not crucial and can be different in different embodiments. In the example embodiment, the margins $X_3$, $X_4$, $X_5$, and $X_6$ all have the same value, but in other embodiments, the margins $X_3$, $X_4$, $X_5$, and $X_6$ may have different values. In some embodiments, the $X_3$, $X_4$, $X_5$, and $X_6$ all have a value of five. For each of the temperatures, the controller 260 compares the internal component temperature to the saturated suction temperature $T_{SAT}$ less the appropriate margin and continues to comparison with the temperature of the next component if the temperature of the component is not less than the saturated suction temperature $T_{SAT}$ minus the margin. If none of the internal components has a temperature less than the saturated suction temperature $T_{SAT}$ minus the margin, the controller 260 proceeds to 812 and takes no remedial action. After taking no remedial action at 812, the controller 260 may either exit the method 800 or return to 802. If any of the internal components does have a temperature less than the saturated suction temperature $T_{SAT}$ minus the margin, the controller 260 stops making comparisons and proceeds to 810 and takes remedial action. The remedial action may be any of the remedial actions discussed above, or any other suitable remedial action.

Figure 9:
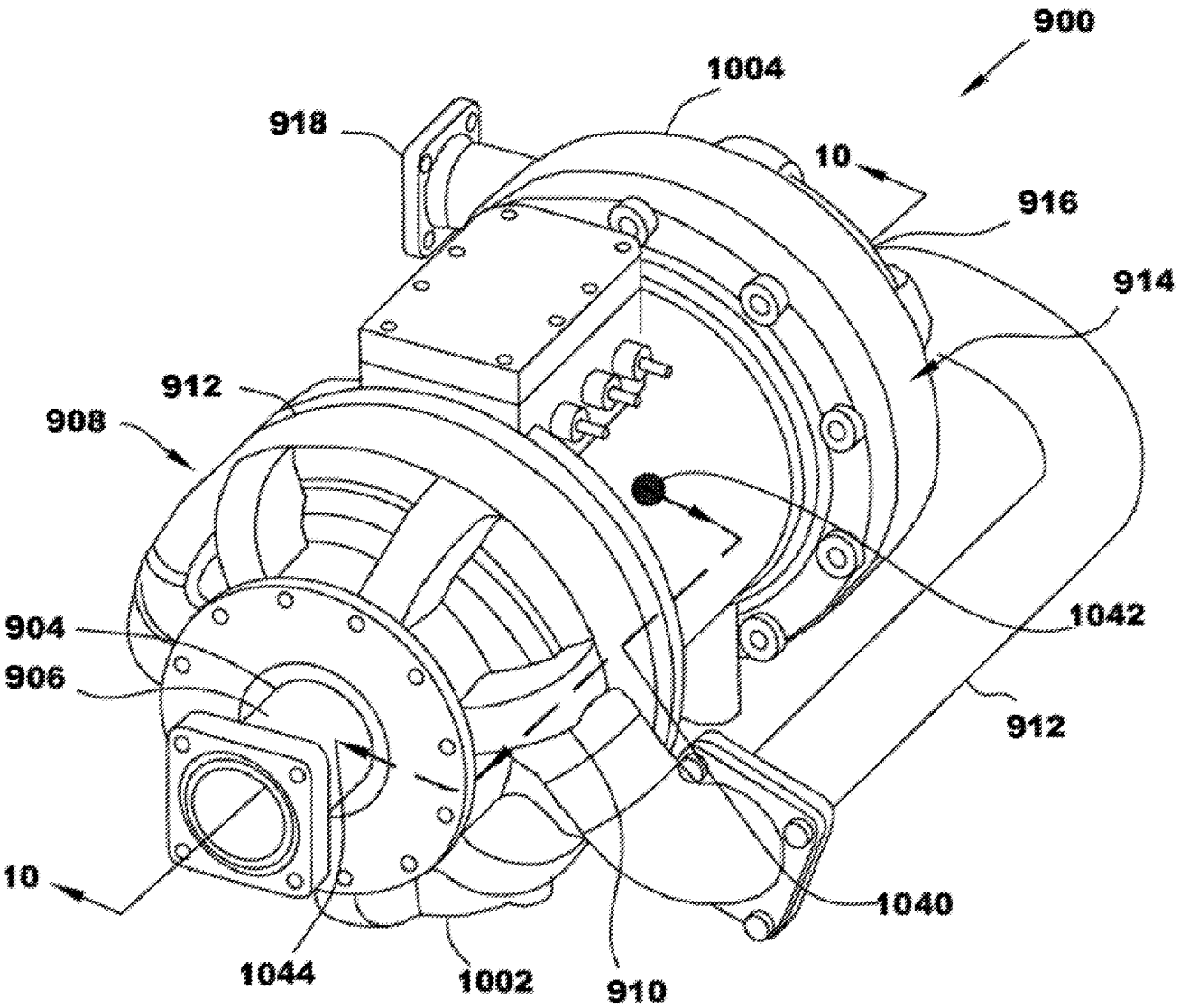
FIG. 9 is a perspective view of an assembled compressor suitable for use in the refrigeration system of FIG. 1 and the compressor cooling system of FIG. 2.
Figure 10:
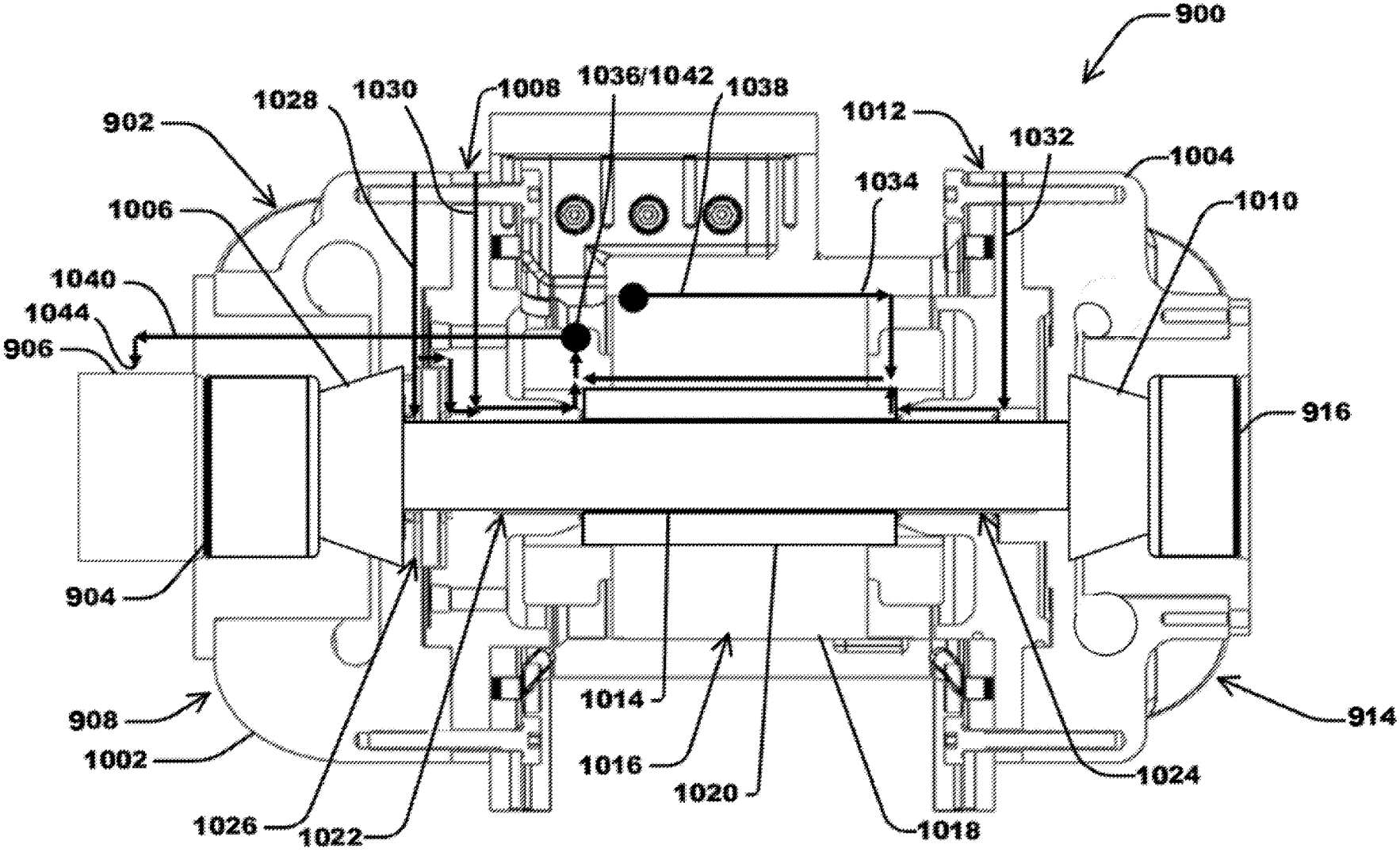
FIG. 10 is a cross-sectional view of the compressor of FIG. 9 taken along line 10-10.

FIG. 9 is a perspective view of an example compressor 900 suitable for use in the refrigeration system 100 of FIG. 1 and the compressor cooling system 200 of FIG. 2. FIG. 10 is a cross-sectional view of the compressor 900 of FIG. 9 taken along line 10-10. In the illustrated embodiment, the compressor 900 is a two-stage centrifugal compressor, although in other embodiments, the compressor 900 may include a single stage or more than two stages. In yet other embodiments, the compressor 900 may be a compressor other than a centrifugal compressor.

The compressor 900 generally includes a compressor housing 902 forming at least one sealed cavity within which each stage of refrigerant compression is accomplished. The compressor 900 includes a first refrigerant inlet 904 that receives refrigerant from a suction line 906 and introduces refrigerant vapor into a first compression stage 908, a first refrigerant exit 910, a refrigerant transfer conduit 912 to transfer compressed refrigerant from the first compression stage 908 to a second compression stage 914, a second refrigerant inlet 916 to introduce refrigerant vapor into the second compression stage 914, and a second refrigerant exit 918. The refrigerant transfer conduit 912 is operatively connected at opposite ends to the first refrigerant exit 910 and the second refrigerant inlet 916, respectively. The second refrigerant exit 918 delivers compressed refrigerant from the second compression stage 914 to a cooling system or refrigeration system (e.g., refrigeration system 100) in which the compressor 900 is incorporated.

With additional reference to FIG. 10, the compressor housing 902 includes a first housing end portion or cap 1002 enclosing the first compression stage 908, and a second housing end portion or cap 1004 enclosing the second compression stage 914. The first compression stage 908 and the second compression stage 914 are positioned at opposite ends of the compressor 900 but can also be located at the same end of the compressor 900. The first compression stage 908 includes a first impeller 1006 configured to add kinetic energy to refrigerant entering via the first refrigerant inlet 904. The kinetic energy imparted to the refrigerant by the first impeller 1006 is converted to increased refrigerant pressure (i.e., compression) as the refrigerant velocity is slowed upon transfer to a sealed cavity (e.g., a diffuser). Similarly, the second compression stage 914 includes a second impeller 1010 configured to add kinetic energy to refrigerant transferred from the first compression stage 908 entering via the second refrigerant inlet 916. The kinetic energy imparted to the refrigerant by the second impeller 1010 is converted to increased refrigerant pressure (i.e., compression) as the refrigerant velocity is slowed upon transfer to a sealed cavity (e.g., a diffuser). Compressed refrigerant exits the second compression stage 914 via the second refrigerant exit 918.

The first impeller 1006 and second impeller 1010 are coupled at opposite ends of a driveshaft 1014. The driveshaft 1014 is operatively coupled to a motor 1016 positioned between the first impeller 1006 and second impeller 1010 such that the first impeller 1006 and second impeller 1010 are rotated at a rotation speed selected to compress the refrigerant to a pre-selected target (e.g., mass flow) exiting the second refrigerant exit 918. Any suitable motor may be incorporated into the compressor 900 including, but not limited to, an electrical motor. The example compressor 900 includes an electrical motor having a stator 1018 connected to the compressor housing 902, and a rotor 1020 connected to the driveshaft 1014. An air gap (not labeled in FIG. 10) is defined between the stator 1018 and the rotor 1020 and allows coolant to flow therethrough. The driveshaft 1014 is supported by first and second radial foil bearings 1022, 1024, and a thrust foil bearing 1026. Additional details of the compressor 900, such as additional components and operation of the compressor 900, are described in U.S. Patent Application Publication No. 2020/0256347, the disclosure of which is incorporated herein by reference.

As shown in FIG. 10, the compressor housing 902 has a plurality of coolant flow channels 1028, 1030, 1032, 1034 defined therein that delivers coolant to the bearings 1022, 1024, 1026 and the motor 1016. The example compressor 900 includes a first coolant flow channel 1028, a second coolant flow channel 1030, a third coolant flow channel 1032, and a fourth coolant flow channel 1034. The first coolant flow channel 1028 delivers coolant to the thrust bearing 1026, the second coolant flow channel 1030 delivers coolant to the first radial bearing 1022, the third coolant flow channel 1032 delivers coolant to the second radial bearing 1024, and the fourth coolant flow channel 1034 delivers coolant to the motor 1016. The compressor housing 902 also defines a common coolant outlet port 1036 in the illustrated embodiment. The common coolant outlet port 1036 receives coolant from each of the plurality of coolant flow channels 1028, 1030, 1032, 1034.

The first coolant flow channel 1028 extends radially inward through the first housing end portion 1002, around the thrust bearing 1026, axially along the driveshaft 1014 between the first bearing housing 1008 and the driveshaft 1014, and radially outward to the common coolant outlet port 1036. The second coolant flow channel 1030 extends radially inward through the first bearing housing 1008 to the first radial bearing 1022, axially along the first radial bearing 1022 and the driveshaft 1014, and radially outward to the common coolant outlet port 1036. The third coolant flow channel 1032 extends radially inward through the second bearing housing 1012 to the second radial bearing 1024, axially along the second radial bearing 1024 and the driveshaft 1014, radially outward toward the air gap defined between the stator 1018 and the rotor 1020, axially through the air gap, and radially outward to the common coolant outlet port 1036. The fourth coolant flow channel 1034 extends helically around the stator 1018 through a spiral groove 1038 defined by the compressor housing 902. The fourth coolant flow channel 1034 then extends radially inward to the air gap defined between the stator 1018 and rotor 1020, axially through the air gap, and then radially outward to the common coolant outlet port 1036.

As shown in FIG. 10, the coolant flow channels 1028, 1030, 1032, 1034 can share common or overlapping portions of the compressor housing 902. For example, the first coolant flow channel 1028 overlaps with and feeds into the second coolant flow channel 238 at the first radial bearing 1022, and the third coolant flow channel 1032 overlaps with and feeds into the fourth coolant flow channel 1034 at the motor 1016. Moreover, as shown in FIG. 10 and described above, the coolant flow channels 1028, 1030, 1032, 1034 within the example compressor housing 902 are arranged such that coolant flows through at least one of the coolant flow channels 1028, 1030, 1032, 1034, in series, across at least one of the bearings 1022, 1024, 1026, through the motor 1016, and to the common coolant outlet port 1036. For example, the third coolant flow channel 1032 delivers coolant to the second radial bearing 1024 and the motor 1016 (e.g., by flowing across the stator 1018 and rotor 1020), resulting in coolant absorbing heat from both the bearings 1022, 1024, 1026 and the motor 1016.

A coolant return line 1040 (shown schematically in FIGS. 9 and 10) has an inlet 1042 connected to the common coolant outlet port 1036, and an outlet 1044 connected to the suction line 906 to return coolant to a low-pressure side of the compressor 900. The suction line 906 is generally at a lower pressure than the coolant delivered to the compressor housing 902, which can be supplied from a relatively high pressure side of a refrigeration system in which the compressor 900 is incorporated, such as downstream of the condenser. As a result, a pressure differential exists between coolant at the coolant source and the suction line 906 and facilitates driving coolant through the plurality of coolant flow channels 1028, 1030, 1032, 1034.

Example embodiments of compressor systems and methods, such as refrigerant compressors, are described above in detail. The systems and methods are not limited to the specific embodiments described herein, but rather, components of the system and methods may be used independently and separately from other components described herein. For example, the cooling circuits described herein may be used in compressors other than centrifugal compressors, including, for example and without limitation, scroll compressors, rotary compressors, and reciprocating compressors.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing (s) shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compressor system comprising:

a compressor comprising:

a compressor housing defining a coolant inlet located on a low-pressure side of the compressor;

a shaft rotatably supported in the compressor housing; and a motor operably connected to the shaft, wherein the compressor housing includes a motor coolant flow channel that delivers coolant to the motor;

a cooling circuit comprising:

a motor coolant supply line connected to the compressor housing to deliver coolant to the motor coolant flow channel, the motor coolant supply line including a motor coolant control valve to control coolant flow through the motor coolant supply line;

a coolant return line that receives coolant from the motor coolant flow channel and returns coolant to the coolant inlet or another portion of the compressor; and a temperature sensor connected to the coolant return line to detect a coolant return temperature, the coolant return temperature being a temperature of the coolant return line or a temperature of coolant within the coolant return line; and a controller having a processor and a memory, the controller connected to the temperature sensor and the motor coolant control valve, the memory storing instructions that when executed by the processor configure the controller to:

control the compressor to compress refrigerant delivered to the coolant inlet;

command the motor coolant control valve at a first time to open to provide a supply of coolant to the motor coolant flow channel;

receive a first detection of the coolant return temperature from the temperature sensor at the first time;

receive a second detection of the coolant return temperature from the temperature sensor at a second time after the first time;

determine, based on the first detection and the second detection of the coolant return temperature, if the motor coolant control valve opened at the first time by:

determining that the motor coolant control valve opened at the first time if the second detection of the coolant return temperature exceeds the first detection of the coolant return temperature by at least a threshold amount; and determining that the motor coolant control valve did not open at the first time if:

the second detection of the coolant return temperature does not exceed the first detection of the coolant return temperature by the threshold amount; and the second time is at least a time threshold after the first time; and take remedial action when the controller determines that the motor coolant control valve did not open at the first time.

2. The compressor system of claim 1, wherein the threshold amount is a predetermined value.

3. The compressor system of claim 2, wherein the predetermined value is three degrees Fahrenheit.

4. The compressor system of claim 1, wherein the threshold amount has a variable value.

5. The compressor system of claim 4, wherein the threshold amount varies based at least in part on one or more of a value of the first detection of the coolant return temperature, a temperature of the motor, and an expected coolant flow rate.

6. The compressor system of claim 1, wherein the time threshold is a predetermined time after the first time.

7. The compressor system of claim 6, wherein the predetermined time is fifteen seconds.

8. The compressor system of claim 1, wherein the time threshold is a variable time after the first time.

9. The compressor system of claim 1, wherein the controller is configured to take remedial action by attempting again to open the motor coolant control valve.

10. The compressor system of claim 1, wherein the controller is configured to take remedial action by generating a warning that the motor coolant control valve did not open when the controller attempted to open it.

11. The compressor system of claim 10, wherein the controller is configured to store the warning in the memory for later retrieval.

12. The compressor system of claim 10 further comprising a human cognizable output device, wherein the controller is configured to generate the warning by outputting a warning on the human cognizable output device.

13. The compressor system of claim 10, wherein the controller further comprises a communication interface, and the controller is configured to generate the warning by outputting an electronic warning to a remote device using the communication interface.

14. The compressor system of claim 1, wherein the controller is configured to take remedial action by stopping operation of the compressor.

15. A method of operating a compressor system including a compressor, the method comprising:

controlling the compressor to compress refrigerant delivered to a coolant inlet of the compressor;

commanding a motor coolant control valve to open at a first time to provide a supply of coolant to a motor coolant flow channel that delivers coolant to a motor of the compressor;

receiving, at the first time, a first detection of a coolant return temperature from a temperature sensor connected to a coolant return line that receives coolant from the motor coolant flow channel and returns coolant to the coolant inlet or another portion of the compressor;

receiving a second detection of the coolant return temperature from the temperature sensor at a second time after the first time;

determining, based on the first detection and the second detection of the coolant return temperature, if the motor coolant control valve opened at the first time by:

determining that the motor coolant control valve opened at the first time if the second detection of the coolant return temperature exceeds the first detection of the coolant return temperature by at least a threshold amount; and determining that the motor coolant control valve did not open at the first time if:

the second detection of the coolant return temperature does not exceed the first detection of the coolant return temperature by the threshold amount; and the second time is at least a time threshold after the first time; and attempting again to determine if the motor coolant control valve opened at the first time if:

the second detection of the coolant return temperature does not exceed the first detection of the coolant return temperature by the threshold amount; and the second time is less than the time threshold after the first time; and taking remedial action when the motor coolant control valve is determined not to have opened at the first time.

16. The method of claim 15, wherein attempting again to determine if the motor coolant control valve opened at the first time comprises:

receiving a third detection of the coolant return temperature from the temperature sensor at a third time after the first time;

determining that the motor coolant control valve opened at the first time if the third detection of the coolant return temperature exceeds the first detection of the coolant return temperature by at least the threshold amount;

determining that the motor coolant control valve did not open at the first time if:

the third detection of the coolant return temperature does not exceed the first detection of the coolant return temperature by the threshold amount; and the third time is at least the time threshold after the first time; and attempting again to determine if the motor coolant control valve opened at the first time if:

the third detection of the coolant return temperature does not exceed the first detection of the coolant return temperature by the threshold amount; and the third time is less than the time threshold after the first time.

17. The method of claim 15, wherein taking remedial action when the controller determines that the motor coolant control valve did not open at the first time comprises at least one of attempting again to open the motor coolant control valve and generating a warning that the motor coolant control valve did not open when the controller attempted to open it.

18. A method of operating a compressor system including a compressor, the method comprising:

controlling the compressor to compress refrigerant delivered to a coolant inlet of the compressor;

commanding a motor coolant control valve to open at a first time to provide a supply of coolant to a motor coolant flow channel that delivers coolant to a motor of the compressor;

receiving, at the first time, a first detection of a coolant return temperature from a temperature sensor connected to a coolant return line that receives coolant from the motor coolant flow channel and returns coolant to the coolant inlet or another portion of the compressor;

periodically receiving additional detections of the coolant return temperature from the temperature sensor;

determining, for each additional detection, if the additional detection exceeds a sum of the first detection and a threshold amount;

determining that the motor coolant control valve opened at the first time and stopping determining if the additional detection exceeds the sum when one of the additional detections exceeds the sum of the first detection and the threshold amount;

determining that the motor coolant control valve did not open at the first time and stopping determining if the additional detection exceeds the sum when none of the additional detections exceeds the sum of the first detection and the threshold amount and a predetermined length of time has passed after the first time; and generating a warning when the motor coolant control valve is determined not to have opened at the first time.

* * * * *